US012653359B2

(12) United States Patent
Ito

(10) Patent No.: US 12,653,359 B2
(45) Date of Patent: Jun. 16, 2026

(54) STOOL WITH VERTICALLY ELONGATED HANDLE

(71) Applicant: Yuzuru Ito, Plymouth, MI (US)

(72) Inventor: Yuzuru Ito, Plymouth, MI (US)

( * ) Notice: Subject to any disclaimer, the term of this patent is extended or adjusted under 35 U.S.C. 154(b) by 139 days.

(21) Appl. No.: 18/132,960

(22) Filed: Apr. 10, 2023

(65) Prior Publication Data

US 2023/0320490 A1 Oct. 12, 2023

Related U.S. Application Data

(60) Provisional application No. 63/341,931, filed on May 13, 2022, provisional application No. 63/329,464, filed on Apr. 10, 2022.

(51) Int. Cl.

| | |
|---|---|
| ***A47C 9/02*** | (2006.01) |
| ***A47B 23/06*** | (2006.01) |
| ***A47C 9/00*** | (2006.01) |
| ***A47C 9/10*** | (2006.01) |
| ***A47C 12/00*** | (2006.01) |
| ***A47C 16/02*** | (2006.01) |
| ***A47C 17/00*** | (2006.01) |
| ***A47K 17/02*** | (2006.01) |
| *A47K 17/00* | (2006.01) |

(52) U.S. Cl.

CPC ..... *A47K 17/028* (2013.01); *A47B 23/06* (2013.01); *A47C 9/00* (2013.01); *A47C 9/025* (2013.01); *A47C 9/10* (2013.01); *A47C 12/00* (2013.01); *A47C 16/02* (2013.01); *A47K 2017/006* (2013.01)

(58) Field of Classification Search

CPC ..... A47K 17/028; A47K 2017/006; A47B 23/06; A47B 19/002; A47C 9/00; A47C 9/025; A47C 9/10; A47C 12/00; A47C 16/02; A47C 4/04; A47C 4/10; A47C 4/20; A47C 4/045

USPC ..... 297/16.2, 183.1, 183.9, 423.39; 4/254

See application file for complete search history.

(56) References Cited

U.S. PATENT DOCUMENTS

| | | | | |
|---|---|---|---|---|
| 933,148 | A * | 9/1909 | Wilson | A47K 17/028 4/254 |
| 2,002,118 | A * | 5/1935 | Johnson | A45B 5/00 297/118 |
| 2,083,605 | A * | 6/1937 | Jertberg | A47K 17/028 297/423.45 |

(Continued)

FOREIGN PATENT DOCUMENTS

| | | | | |
|---|---|---|---|---|
| JP | 2015080724 | A * | 4/2015 | A45B 5/00 |

*Primary Examiner* — Robert Canfield

(57) ABSTRACT

A stool comprising a plurality of hinges and a plurality of supporting members connected via the plurality of hinges. The stool further comprises a handle connected to one of the plurality of supporting members with a connecting member. The plurality of supporting members including at least two top members, a front member, a back member, a pair of right-side members and a pair of left side members. The handle includes a top part, a middle part and a bottom part. The bottom part of the handle is connected to one of the plurality of supporting members with a joining component. The plurality of supporting members are in open position when pushed down against the floor by applying the downward force through the handle. The handle further comprises a lever mechanism to fold the plurality of supporting members when the long handle is lifted.

17 Claims, 45 Drawing Sheets

(56) References Cited

U.S. PATENT DOCUMENTS 2,133,047 A * 10/1938 Sheldon ..... A45B 5/00 297/55
2,311,049 A * 2/1943 Hedden ..... A61H 3/02 224/0.5
2,649,140 A * 8/1953 Housel ..... A45B 5/00 248/431
D201,796 S * 8/1965 Rolley ..... D6/349
3,266,839 A * 8/1966 Combs ..... A45B 5/00 248/155
3,310,340 A * 3/1967 Brewer ..... A45B 5/00 297/16.2
3,429,541 A * 2/1969 Herman ..... A61H 3/02 248/302
3,841,437 A * 10/1974 Caughey ..... E06C 1/005 182/16
3,884,327 A * 5/1975 Zigman ..... E06C 1/39 182/113
D251,098 S * 2/1979 Diedrich ..... D6/354
4,148,523 A * 4/1979 Brand ..... A47C 5/10 297/55
4,630,861 A * 12/1986 Henschel ..... A47C 4/08 297/44
4,998,298 A * 3/1991 Mitchell ..... A47K 17/028 182/113
5,101,845 A * 4/1992 Kravetz ..... A61H 3/02 224/407
5,385,163 A * 1/1995 Fairchild ..... A45B 3/00 135/65
5,480,079 A * 1/1996 Douglass ..... A61G 5/10 224/558
5,579,864 A * 12/1996 Shorrock ..... A47C 9/025 182/16
5,752,535 A * 5/1998 Sanders ..... A61H 3/0288 135/86
5,937,968 A * 8/1999 Gibson ..... E06C 1/393 182/129
5,941,262 A * 8/1999 Tschirhart ..... A61H 3/00 135/65
5,983,912 A * 11/1999 Leu ..... A61H 3/02 108/42
6,148,448 A * 11/2000 Urso ..... A47K 17/026 297/423.44
D460,566 S * 7/2002 Henschel ..... D25/65
6,681,410 B1 * 1/2004 Husain ..... A47K 17/028 D6/349
7,261,113 B2 * 8/2007 Tartaglia ..... A45B 1/02 135/84
D615,667 S * 5/2010 Dunn ..... D25/65
7,836,904 B1 * 11/2010 Cushman ..... A45B 3/10 135/65
D707,975 S * 7/2014 Habraken ..... D6/353
8,888,188 B2 * 11/2014 Moffat ..... A47C 3/16 297/423.11
9,545,355 B1 * 1/2017 Welch ..... H04B 1/3888
10,271,655 B1 * 4/2019 Gwen ..... A47C 4/10
D849,429 S * 5/2019 Husain ..... D6/349
10,694,859 B1 * 6/2020 Wickland ..... A47C 4/045
D894,585 S * 9/2020 Ye ..... D3/7
10,881,256 B1 * 1/2021 Luque, Jr. ..... A47K 17/028
11,903,486 B2 * 2/2024 Dokhanian ..... A47C 4/045
11,950,735 B1 * 4/2024 Griffin ..... A47K 3/281
2003/0159727 A1 * 8/2003 Satterthwaite ..... A61H 3/00 135/65
2006/0070808 A1 * 4/2006 Moldthan ..... E06C 1/393 182/180.1
2009/0261643 A1 * 10/2009 Kay ..... A47C 9/10 297/335
2009/0294214 A1 * 12/2009 Vosbikian ..... A47C 12/00 182/129
2011/0114419 A1 * 5/2011 Merey ..... E06C 1/383 182/152
2014/0131138 A1 * 5/2014 Simpson ..... A47C 12/00 182/223
2015/0272410 A1 * 10/2015 Lavassani ..... A47K 17/028 4/254
2015/0322717 A1 * 11/2015 Gibson ..... A47C 12/00 182/210
2016/0113388 A1 * 4/2016 Distefano ..... A45C 5/14 108/41
2016/0220026 A1 * 8/2016 Siao ..... A47C 4/045
2017/0215594 A1 * 8/2017 Baker ..... A47C 12/00
2020/0046180 A1 * 2/2020 Nethercott ..... A47K 17/028
2021/0085086 A1 * 3/2021 Dokhanian ..... E06C 1/005
2023/0363538 A1 * 11/2023 Bergman ..... A47C 12/00
2024/0108144 A1 * 4/2024 Merey ..... A47C 12/00

* cited by examiner

STOOL WITH VERTICALLY ELONGATED HANDLE

CROSS-REFERENCE TO RELATED APPLICATION

This disclosure claims the benefit of the priority of U.S. Provisional Patent Application No. 63/329,464 entitled "Stool With handle" and filed on Apr. 10, 2022. This disclosure claims the benefit of the priority of U.S. Provisional Patent Application No. 63/341,931 entitled "Stool with handle" and filed on May 13, 2022. The above-identified applications are incorporated herein by reference in its entirety.

TECHNICAL FIELD

The present invention pertains generally to stools. More particularly, embodiments of the present invention provide a foldable or collapsible stool with a long handle.

BACKGROUND ART

A stool that can be conveniently stored and moved to and from the floor has been acknowledged as being advantageous. A stool that can lock into a position for safety has also been acknowledged as being advantageous.

Existing stools must be moved by end users while bending over to pick them up, placing additional strain on their backs. Additionally, end users must hold any necessary items with their hands, which is uncomfortable, especially when unrolling toilet paper, when they use the stools to elevate their feet while sitting on a toilet for a bowel movement.

It is frequently desirable to have a foldable, portable stool that can be used in a variety of settings and is simple to move from one location to another. It is also useful to have a portable stool available that can be folded up into a small space for storage and transportation.

In view of above, there is an urgent need for a technical solution that overcomes the aforementioned limitations. The focus of this disclosure is to provide a collapsible stool with a long handle or a foldable stool.

SUMMARY OF THE DISCLOSURE

The following is a summary description of illustrative embodiments of the invention. It is provided as a preface to assist those skilled in the art to more rapidly assimilate the detailed design discussion which ensues and is not intended in any way to limit the scope of the claims which are appended hereto in order to particularly point out the invention.

According to illustrative embodiments, the present disclosure focuses on a foldable stool which overcomes the above mentioned disadvantages or provides the users with a useful or commercial choice.

An object of the present invention is to design a foldable stool which could be folded into a compact size and shape.

Another object of the present invention is to provide a portable and user-friendly stool.

The present inventions seek to provide solutions to the problem(s) by providing stools with a long handle which pivots on the stool with a feature to hold items.

According to the first aspect of the present disclosure, a stool is disclosed. The stool includes a plurality of hinges. The stool also includes a plurality of supporting members connected via the plurality of hinges. The stool also includes a handle connected to one of the pluralities of supporting members with a connecting member. The handle includes a top part, a middle part and a bottom part. The bottom part of the handle is connected to one of the pluralities of supporting members with a joining component.

In one embodiment, the plurality of supporting members including at least two top members, a front member, a back member, a pair of right-side members and a pair of left side members.

In one embodiment, the bottom part of the handle is connected to at least two top supporting members with the joining components. In one of the embodiments, the joining component includes at least two link plates, a pluralities of pins and washers.

In one embodiment, the handle comprises side edges having at least two protrusions on both edges and the at least two top members is located between the at least two protrusions of the handle.

In one embodiment, the plurality of supporting members are in open position when pushed down against the floor by applying the downward force through the handle.

In one embodiment, the handle comprises a lever mechanism to fold the plurality of supporting members when the long handle is lifted.

In one embodiment, the joining component comprises a link plate, a pair of link plates, at least two link plate, and so forth.

In one embodiment, the handle comprises a foldable component attached to the bottom part of the handle, the foldable component is coupled to one of the pluralities of supporting members. The handle further comprises an actuating component located in the middle part of the handle, the actuating component is coupled to the foldable component. The handle also includes a pulling lever mechanism located in the top part of the handle and coupled to the actuating component. The pulling lever mechanism is configured to fold the plurality of supporting members via the actuating component when the pulling lever is pulled.

In one embodiment, the plurality of supporting members is in open position when the pulling lever is released.

In one embodiment, the connecting member comprises at least one pivot pin, linkages, a hinge mechanism, and so forth.

In one embodiment, the plurality of supporting members including a right leg, a left leg, a right top plate, a left top plate, a center connecting member, and so forth.

In one embodiment, the center connecting member and the handle are connected with a hinge component.

In one embodiment, the handle comprises a storage shelf for storing a plurality of objects.

In one embodiment, the top part of the handle is detachably connected to the middle part of the handle via a latching mechanism.

According to the second aspect of the present disclosure, a foldable stool is disclosed. The foldable stool includes a plurality of hinges. The foldable stool also includes plurality of supporting members connected via the plurality of hinges. The plurality of supporting members includes at least two top members, a front member, a back member, a pair of right-side members and a pair of left side members. The foldable stool also includes a long handle connected to the at least two top members with a connecting member. The long handle includes a top part, a middle part and a bottom part. Further, the bottom part of the handle is connected to the back member of the plurality of supporting members with a link plate. Moreover, the long handle includes a pulling lever mechanism to fold the plurality of supporting members when the long handle is lifted.

In one embodiment, the plurality of supporting members is in open position when pushed down against the floor by applying the downward force through the long handle.

In one embodiment, the connecting member comprises at least one pivot pin, linkages, and so forth.

In one embodiment, the connecting member comprises a hinge mechanism.

In one embodiment, the top part of the long handle is detachably connected to the middle part of the long handle via a latching mechanism.

According to the third aspect of the present disclosure, a collapsible stool is disclosed. The collapsible stool includes a plurality of hinges. The collapsible stool also includes a plurality of supporting members connected via the plurality of hinges. The plurality of supporting members includes at least two top members, a front member, a back member, a pair of right-side members and a pair of left side members. The collapsible stool also includes a long handle connected to the at least two top members with a connecting member. The long handle includes a top part, a middle part, and a bottom part. The bottom part of the long handle is connected to the back member of the plurality of supporting members with at least two link plates. The long handle further includes at least two link plates attached to the bottom part of the long handle, the at least two link plates are coupled to one of the pluralities of supporting members. The long handle further includes an actuating component located in the middle part of the long handle, the actuating component is coupled to at least two link plates. The long handle further includes a pulling lever mechanism located in the top part of the long handle and coupled to the actuating component. Moreover, the pulling lever mechanism is configured to fold the plurality of supporting members via the actuating component when the pulling lever is pulled.

In one of the embodiments, a foldable stool is disclosed comprising a plurality of hinges, a plurality of supporting members connected via the plurality of hinges, the plurality of supporting members including at least two top members, a front member, a back member, a pair of right-side members and a pair of left side members, a long handle comprising an outer hollow member and an inner trigger member housed in the outer hollow member, wherein the inner trigger member has a bottom part configured to perform a first hinge mechanism, the first hinge mechanism is configured for deploying the pluralities of the support members to open the stool; and the outer hollow member is configured to perform a second hinge mechanism that is configured to close the supporting members.

In the embodiment, the outer hollow member of the foldable stool comprises of a first outer member and a second outer member, the second outer member fits into the first outer member to form a housing to house the inner trigger member.

In the embodiment, the first hinge mechanism is triggered by a trigger point of the inner trigger member, the first hinge mechanism is configured at the bottom part of the inner trigger member comprising a bottom hole, a first link plate having a first link plate hole, a second link plate having a second link plate hole, a washer and a short pin.

In the embodiment, the second hinge mechanism comprises a plurality of holes at first outer member, a plurality of holes at second outer member, a notch on the inner trigger member and long pin that passes through the hinges of the two top supporting members.

In one of the preferred embodiment, a collapsible stool with long handle is disclosed comprising a plurality of hinges, a plurality of supporting members connected via the plurality of hinges, the plurality of supporting members including at least two top members, a front member, a back member, a pair of right-side members and a pair of left side members, a long handle comprising an outer hollow member and an inner trigger member housed in the outer hollow member, wherein the inner trigger member has a bottom part connected to the at least two top support members with a plurality of connecting members, the plurality of connecting members comprising of a bottom hole, a first link plate having a first link plate hole, a second link plate having a second link plate hole, a washer and a short pin, the outer hollow member comprises of a first outer member and a second outer member, the second outer member fits into the first outer member to form a housing to house the inner trigger member, wherein outer hollow member is connected to the top supporting members through a plurality of holes at first outer member, a plurality of holes at second outer member, a notch on the inner trigger member and long pin that passes through the hinges of the two top supporting members, wherein the inner trigger member is adopted to deploy the supporting members by a pull action of a trigger point of the handle, and the outer hollow member of the handle is adopted to close the supporting members by a pull action of grip of the handle.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF DRAWINGS

To describe the technical solutions in the embodiments of the present disclosure or in the prior art more clearly, the following briefly describes the accompanying drawings required for describing the embodiments or the prior art. Apparently, the accompanying drawings in the following description merely show some embodiments of the present disclosure, and a person of ordinary skill in the art can derive other implementations from these accompanying drawings without creative efforts. All of the embodiments or the implementations shall fall within the protection scope of the present disclosure.

FIG. 9 through 11 show the opening progress, according to embodiments of the present invention disclosed herein;

FIG. 10 shows a cross section of the preferred embodiment of the present invention opening in progress with arrows to indicate the movements of each pivot points, the stage is between folded stage shown in FIG. 2 and opened stage shown in FIG. 3, according to embodiments of the present invention disclosed herein;

FIG. 11 shows a cross section bb-bb' of the ISO view in FIG. 3 of the preferred embodiment of the present invention opened with arrows to indicate the movements of each pivotal points, according to embodiments of the present invention disclosed herein;

FIG. 12 through 14 show the folding progress, according to embodiments of the present invention disclosed herein;

FIG. 13 shows a cross section of the preferred embodiment of the present invention folding in progress with arrows to indicate the movements of each pivot points, according to embodiments of the present invention disclosed herein;

FIG. 14 shows a cross section aa-aa' in FIG. 2 of the preferred embodiment of the present invention folded with arrows to indicate the movements of each pivotal points, according to embodiments of the present invention disclosed herein;

FIG. 25 through 27 show the opening progress, according to embodiments of the present invention disclosed herein;

FIG. 26 shows a cross section of the first alternate embodiment of the present invention opening in progress with arrows to indicate the movements of each pivot points. Shown stage is between folded stage shown in FIG. 25 and opened stage shown in FIG. 27 according to embodiments of the present invention disclosed herein;

FIG. 27 shows a cross section dd-dd' of the ISO view in FIG. 19 of the first alternate embodiment of the present invention opened with arrows to indicate the movements of each pivotal points, according to embodiments of the present invention disclosed herein;

FIG. 28 through 30 show the folding progress, according to embodiments of the present invention disclosed herein;

FIG. 29 shows a cross section of the first alternate embodiment of the present invention folding in progress with arrows to indicate the movements of each pivot points, according to embodiments of the present invention disclosed herein;

FIG. 30 shows a cross section of cc-cc' of the ISO view in FIG. 18 of the first alternate embodiment of the present invention folded with arrows to indicate the movements of each pivotal points, according to embodiments of the present invention disclosed herein;

FIG. 48 through 50 show the folding progress, according to embodiments of the present invention disclosed herein;

FIG. 49 shows a cross section of the second alternate embodiment of the present invention folding in progress with arrows to indicate the movements of each pivot points, according to embodiments of the present invention disclosed herein;

FIG. 50 shows a cross section of ee-ee' of the ISO view in FIG. 38 of the second alternate embodiment of the present invention folded with arrows to indicate the movement of each pivotal points, according to embodiments of the present invention disclosed herein;

FIG. 84A shows a back side of the top plate 8006, according to embodiments of the present invention disclosed herein;

The foldable and collapsible stool is illustrated in the accompanying drawings, which like reference letters indicate corresponding parts in the various figures. It should be noted that the accompanying figure is intended to present illustrations of exemplary embodiments of the present disclosure. This figure is not intended to limit the scope of the present disclosure. It should also be noted that the accompanying figure is not necessarily drawn to scale.

DESCRIPTION OF EMBODIMENTS

Those skilled in the art will be aware that the present disclosure is subject to variations and modifications other than those specifically described. It is to be understood that the present disclosure includes all such variations and modifications. The disclosure also includes all such steps, features, compositions and compounds referred to or indicated in this specification, individually or collectively, and any and all combinations of any or more of such steps or features.

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only". Throughout this specification, unless the context requires otherwise the word "comprise", and variations such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Figure 1:
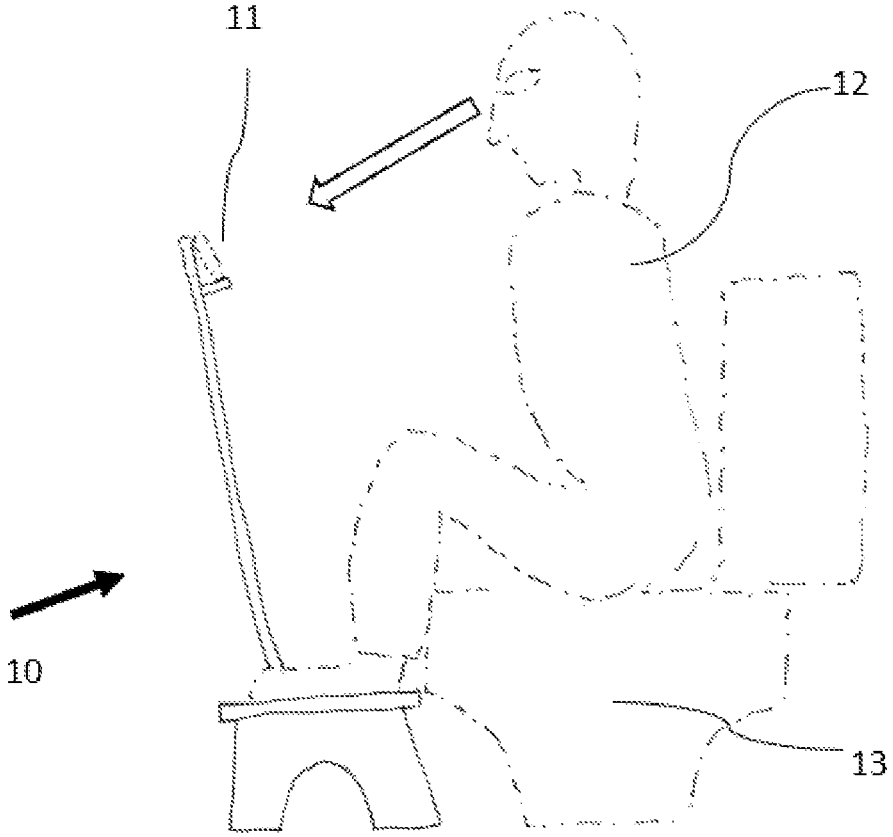
FIG. 1 illustrates a side view of the stool, according to embodiments of the present invention as disclosed herein.

FIGS. 1 to 89D illustrate various views and various embodiments of the stool, according to embodiments of the present invention. The present invention is designed to be used as a stool including, but not limited to a toilet stool, regular stool, or device stand.

FIG. 1 illustrates show a side view with a user 12 sitting on a toilet 13, locating his or her feet on the stool 10 and looking at a smartphone 11 on a storage shelf on the handle. The stool 10 includes a plurality of hinges. The stool 10 also includes a plurality of supporting members connected via the plurality of hinges. In one embodiment in reference to FIG. 2 and FIG. 3, the plurality of supporting members including at least two top members 1002, 1003 (hereinafter may be also referred to as "front top members"), a front member 1004, a back member 1009 (hereinafter may be also referred to as "rear member" and not shown here), a pair of right-side members 1005, 1006 (not shown), and a pair of left side members 1007, 1008. Further, the center connecting member and the handle 1001 (hereinafter may be also referred to as "long handle") are connected with a hinge component.

In another embodiment, the plurality of supporting members includes a right leg, a left leg, a right top plate, a left top plate, a center connecting member, and so forth.

The stool 10 also includes a handle connected to one of the pluralities of supporting members with a connecting member. According to embodiments of the present invention, the connecting member comprises at least one pivot pin, linkages, a hinge mechanism.

The handle 1001 includes an elongated portion with a top part 1001*c*, a middle part 1001*b* and a bottom part 1001*a*. The bottom part of the handle is connected to one of the pluralities of supporting members with a joining component. According to embodiments of the present invention, the joining component comprises a link plate, a pair of link plates, at least two link plates, and so forth. In one of the embodiments, the top part 1001*c* is formed as D shaped grip and middle portion 1001*b* may comprise smart phone holder. In another embodiment, T shaped grip may be adopted.

In one embodiment, the top part 1001*c* of the handle 1001 is detachably connected to the middle part 1001*b* of the handle via a latching mechanism.

Further, the bottom part of the handle 1001 may be connected to at least two top members 1002, 1003 with the joining component.

Figure 2:
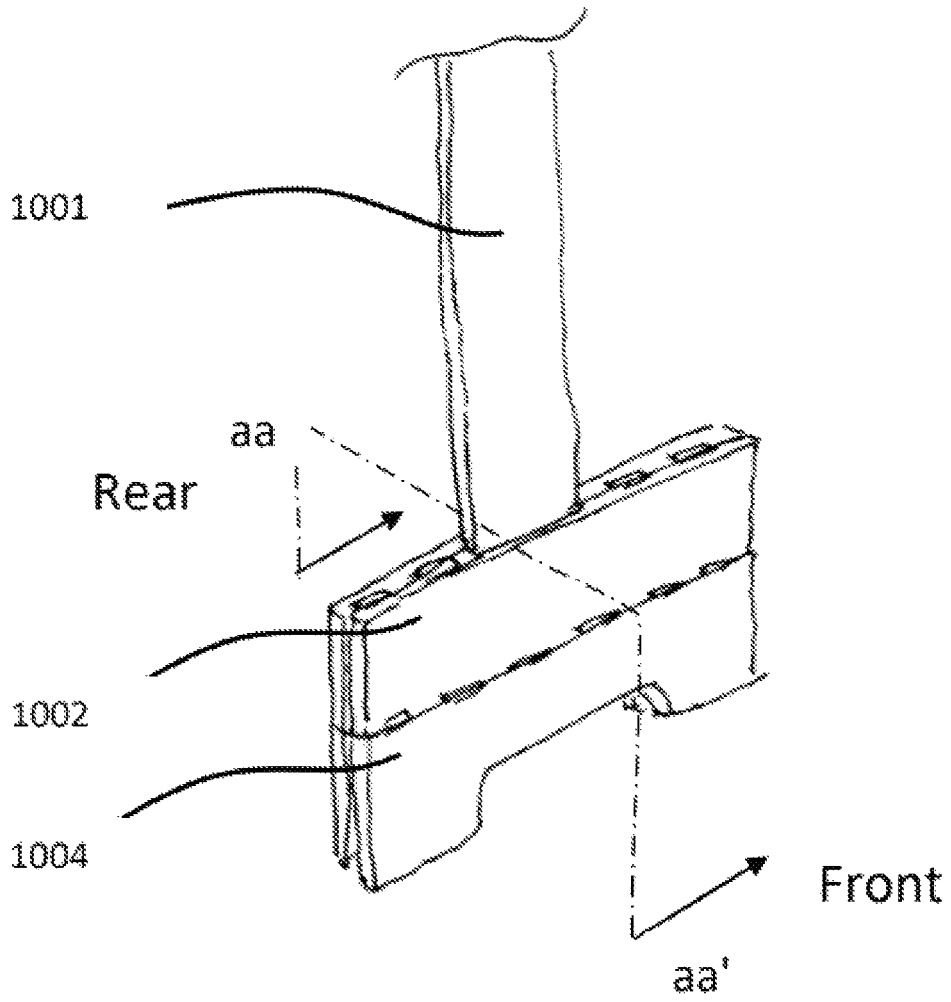
FIG. 2 shows an ISO view of the preferred embodiment of the present invention at its folded stage, according to embodiments of the present invention disclosed herein.
Figure 3:
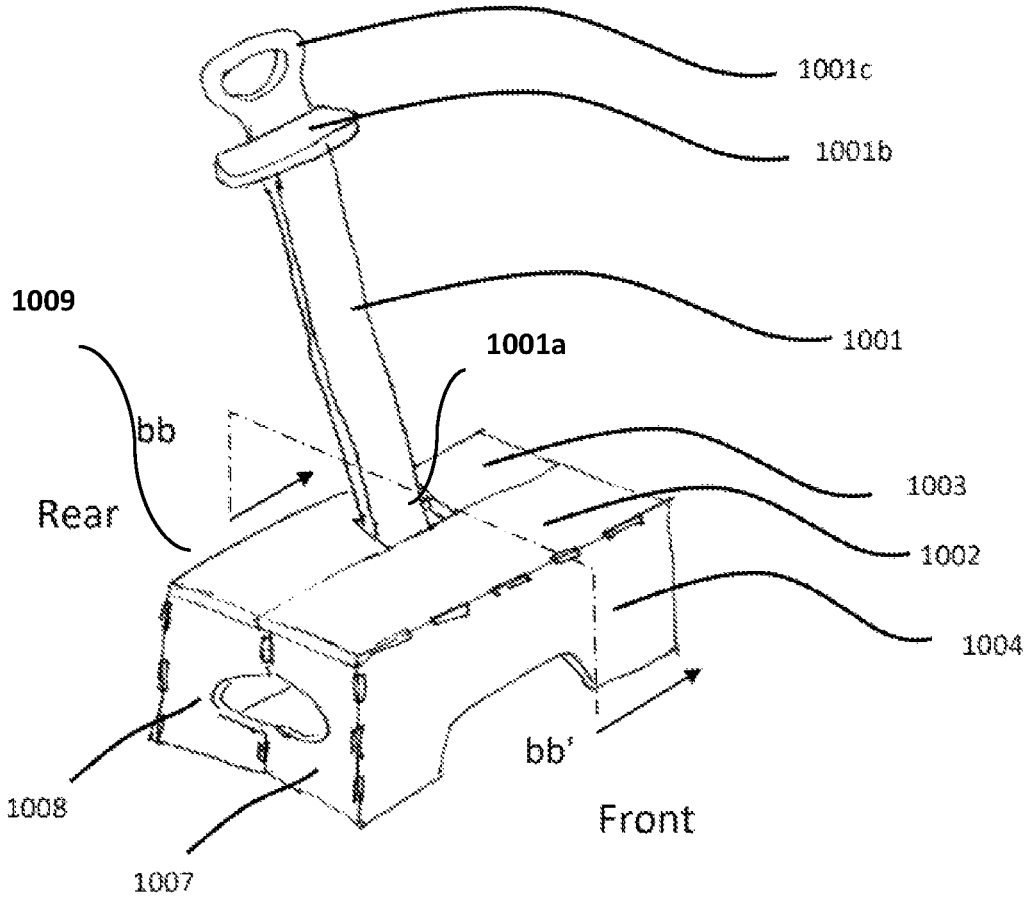
FIG. 3 shows an ISO view of the preferred embodiment of the present invention at its opened stage, according to embodiments of the present invention disclosed herein.

The pluralities of supporting members are in open position when pushed down against the floor by applying the downward force through the handle, as seen in FIGS. 2 and 3. The stool 10 may be shown in an open stage, when the plurality of supporting members is open.

In one embodiment, handle 1001 may include side edges having at least two protrusions on both edges and the at least two top members is located between the at least two protrusions of the handle 1001.

The handle 1001 may comprise a lever mechanism to fold the plurality of supporting members when the handle 1001 is lifted, as seen in FIG. 2. The plurality of supporting members may be folded and stored against the wall, represented by 1000.

Figure 4:
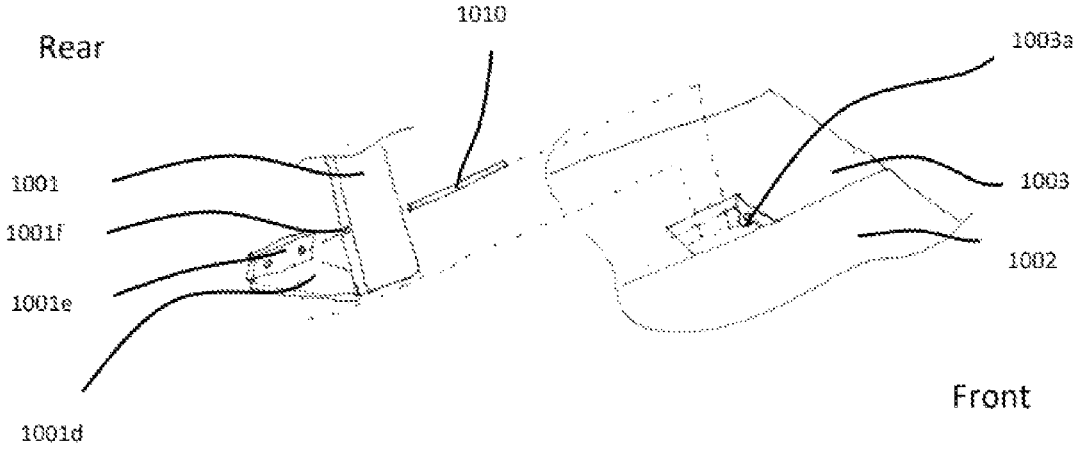
FIG. 4 shows a cross section of bb-bb' shown in FIG. 3 of the preferred embodiment of the present invention at its opened stage, according to embodiments of the present invention disclosed herein.

FIG. 4 shows an ISO view of the linkage mechanism inside the stool 10 of the preferred embodiment of the present invention 1000. FIG. 4 also shows an ISO view of the top members of the preferred embodiment of the present invention. In one embodiment, the handle 1001 comprises a storage shelf (hereinafter may be also referred as the smartphone shelf") for storing a plurality of objects.

In one embodiment, the handle 1001 may comprise a foldable component attached to the bottom part of the handle. The foldable component may be coupled to one of the pluralities of supporting members.

The handle 1001 further comprises an actuating component located in the middle part of the handle; the actuating component is coupled to the foldable component. The handle 1001 also includes a pulling lever mechanism located in the top part of the handle 1001 and coupled to the actuating component. The pulling lever mechanism is configured to fold the plurality of supporting members via the actuating component when the pulling lever is pulled.

Figure 6:
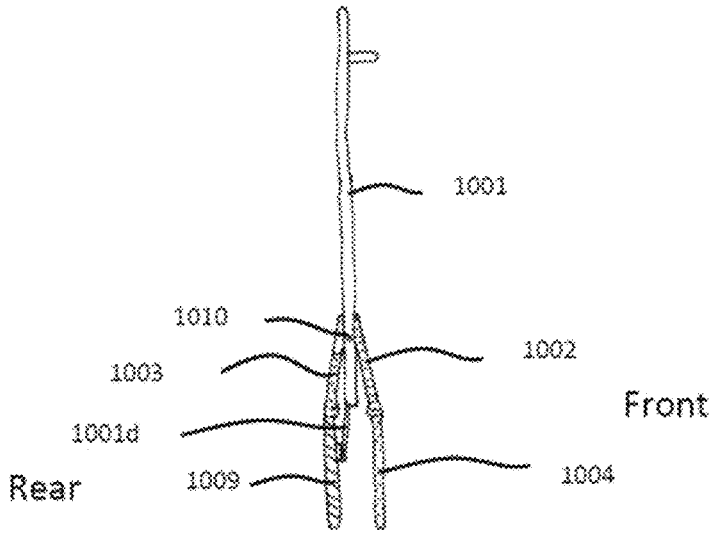
FIG. 6 shows a cross section of aa-aa' shown in FIG. 2 of the preferred embodiment of the present invention at its folded stage, according to embodiments of the present invention disclosed herein.
Figure 8:
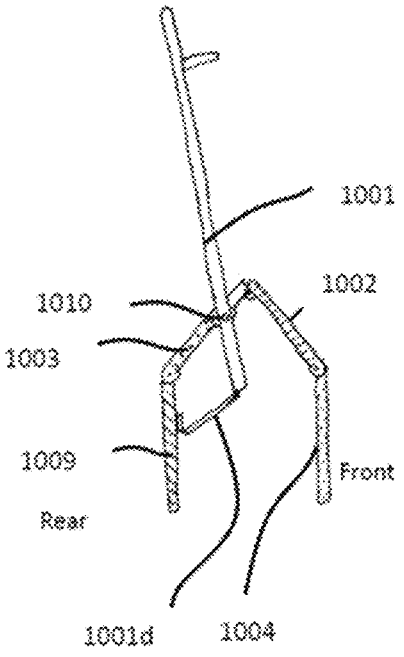
FIG. 8 shows a cross section of the preferred embodiment of the present invention at work in progress between folded stage and opened stage at the same location as the cross section aa-aa' in FIG. 6, according to embodiments of the present invention disclosed herein.

FIG. 8 shows a cross section of the preferred embodiment of the present invention 1000 at work in progress between folded stage and opened stage at the same location as the cross section aa-aa' in FIG. 6.

Moreover, the plurality of supporting members is in open position when the pulling lever is released.

The foldable stool includes a plurality of hinges. The foldable stool also includes plurality of supporting members connected via the plurality of hinges. The plurality of supporting members includes at least two top members, a front member, a back member, a pair of right-side members and a pair of left side members. The foldable stool also includes a long handle connected to at least two top members with a connecting member. In one embodiment, the connecting member comprises at least one pivot pin, linkages, and so forth.

Further, the connecting member comprises a hinge mechanism.

The long handle includes a top part, a middle part and a bottom part. Further, the bottom part of the handle is connected to the back member of the plurality of supporting members with a link plate (hereinafter may be also referred as "linkage plate/plates"). Moreover, the long handle includes a pulling lever mechanism to fold the plurality of supporting members when the long handle is lifted. The top part of the long handle is detachably connected to the middle part of the long handle via a latching mechanism.

The preferred embodiment of the present invention 1000 consists of a long handle 1001, the front top members 1002, the rear top member 1003, the front member 1004, the rear member 1009, the right-side members, and the left-side members 1007,1008 as shown in FIG. 3.

The front top member 1002 and the rear top member 1003 may be connected with a pin(s) or some type of hinge mechanism. The front top member 1002, the rear top member 1003, the front member 1004 and the rear member 1009 may be connected with pins or some type of hinge mechanisms.

The front member 1004, the rear member 1009, right side members 1005,1006 and the left side members 1007, 1008 are connected with pins or some type of hinge mechanisms.

Figure 5:
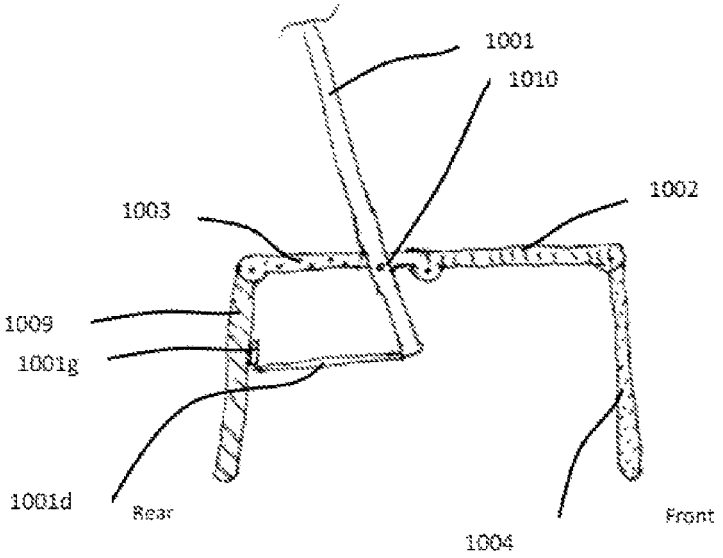
FIG. 5 shows an ISO view of the linkage mechanism inside the stool and the top members of the preferred embodiment of the present invention, according to embodiments of the present invention disclosed herein.

The handle 1001 and the rear top member 1003 are connected with a pin 1010 as shown in FIG. 4 and FIG. 5 or with some type of hinge mechanisms.

The mounting tab 1001*e* in FIG. 4 is connected to the rear member with a pin(s) or other known method in the industry. The tab 1001*e* may be attached to the top rear member 1003.

Intended material used for the preferred embodiment of the present invention 1000 includes, but not limited to some type of plastic.

Figure 7:
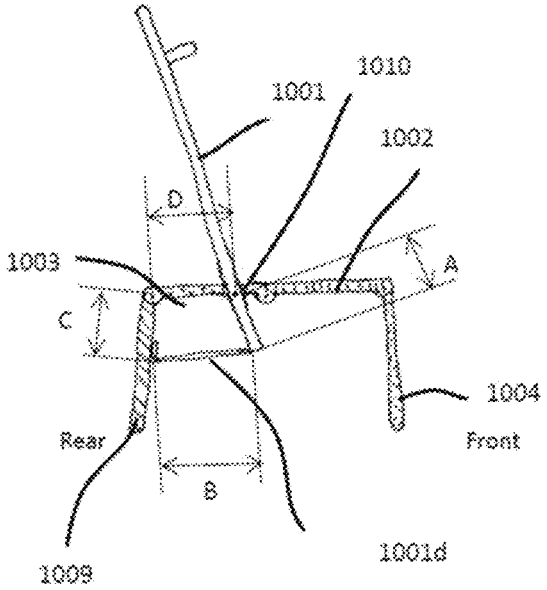
FIG. 7 shows a cross section of bb-bb' shown in FIG. 3 of the preferred embodiment of the present invention at opened stage, according to embodiments of the present invention disclosed herein.

The following is the relative formula for the link mechanism in the preferred embodiment of the present invention 1000. Distance A+B=Distance C+D, as shown in FIG. 7.

The linkage plate 1001*d* may be connected with living hinge with the main part of the handle 1001. Or the linkage plate 1001*d* may be a separate piece made of plastic or some type of flexible material.

Figure 9:
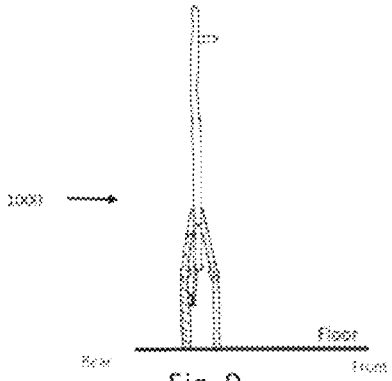
FIG. 9 shows a cross section aa-aa' of the ISO view in FIG. 2 of the preferred embodiment of the present invention on the floor.
Figure 10:
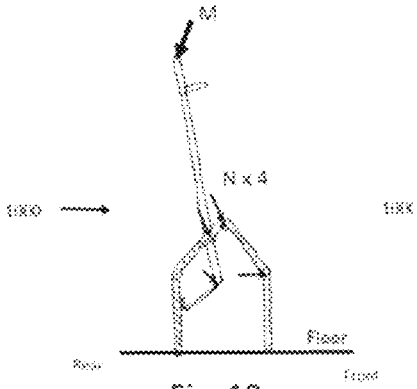
Figure 11:
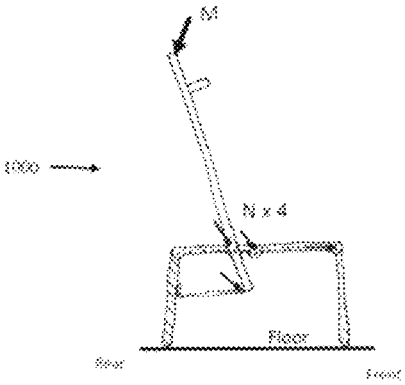

FIG. 9 through FIG. 11 show the progress of opening of the preferred embodiment of the present invention 1000. Pivot points of the present invention move as arrows N×4 indicate when force M is applied to the handle as shown in FIG. 10 and FIG. 11.

Figure 12:
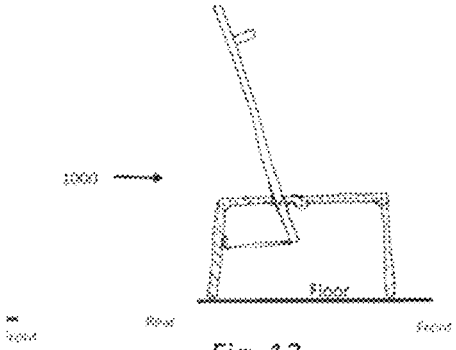
FIG. 12 shows a cross section of the ISO view of bb-bb' in FIG. 3 of the preferred embodiment of the present invention on the floor.
Figure 13:
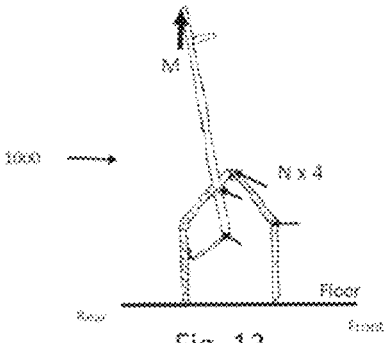
Figure 14:
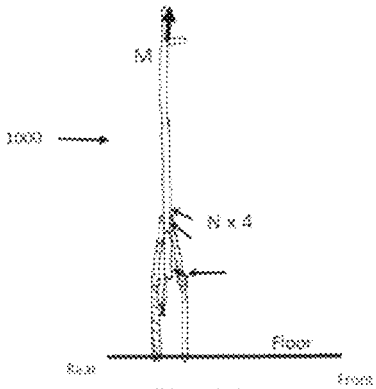

FIG. 12 through FIG. 14 show the progress of folding of the present invention. Pivot points of the present invention move as arrows N×4 indicate when force M is applied to the handle as shown in FIG. 13 and FIG. 14.

Figure 15:
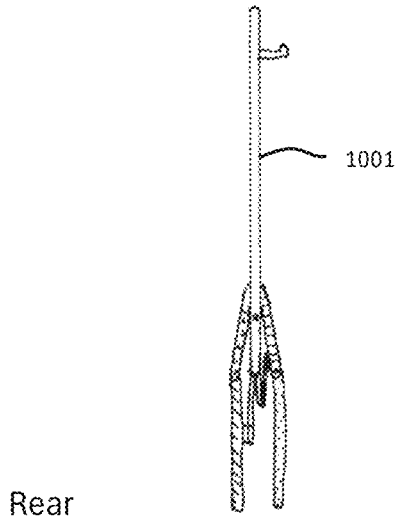
FIG. 15 shows a cross section of aa-aa' shown in FIG. 2 of the preferred embodiment of the present invention at its folded stage. This variation has an added feature for the handle to stay at the frontward position, according to embodiments of the present invention disclosed herein.
Figure 16:
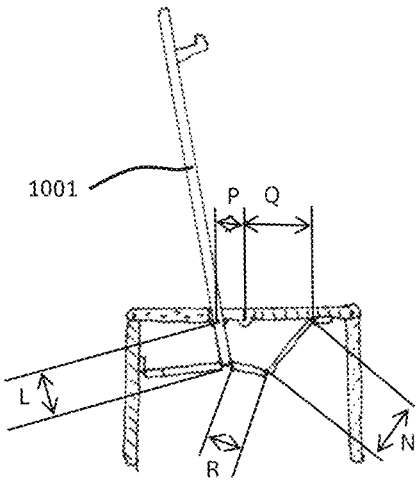
FIG. 16 shows a cross section of bb-bb' shown in FIG. 3 of the preferred embodiment of the present invention at opened stage. This variation has an added feature for the handle to stay at the frontward position, according to embodiments of the present invention disclosed herein.
Figure 17:
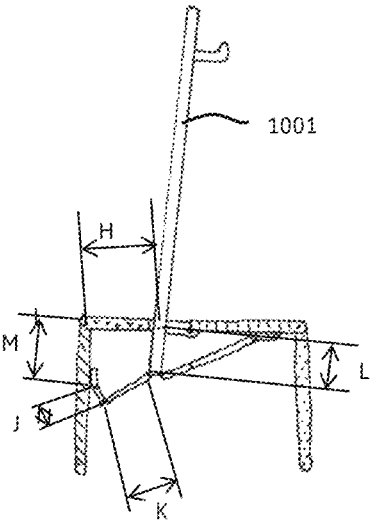
FIG. 17 shows a cross section of bb-bb' shown in FIG. 3 of the preferred embodiment of the present invention at opened stage. Only difference from FIG. 16 is that the handle stays at the frontward position, according to embodiments of the present invention disclosed herein.
Figure 18:
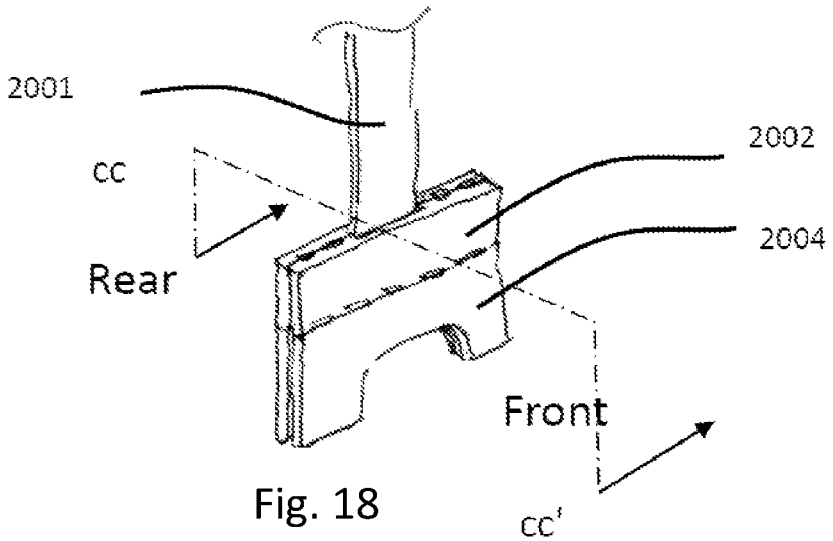
FIG. 18 shows an ISO view of the first alternate embodiment of the present invention at its folded stage, according to embodiments of the present invention disclosed herein.

FIG. 15 shows a variation of a cross section of aa-aa' shown in FIG. 2 of the preferred embodiment of the present invention at its folded stage, where the variation has an added feature for the handle 1001 to stay at a frontward position. FIG. 16 shows the variation of FIG. 15 at its opened stage, to be a variation of a cross section of bb-bb' shown in FIG. 3, where the handle 1001 is in a rearward position. FIG. 17 shows the variation of FIG. 15 at its opened stage, to be a variation of a cross section of bb-bb' shown in FIG. 3, where the handle 1001 is in a frontward position. Referring to FIGS. 16 and 17, the following is the relative formula for the link mechanism in the preferred embodiment of the present invention with added linkage, including segments 1101*d*, 1101*e*, which allows the handle 1001 to stay at the frontward position. Distance L+R=Q−P+N as shown in FIG. 16 Distance L+K=H+M+J as shown in FIG. 17.

Figure 19:
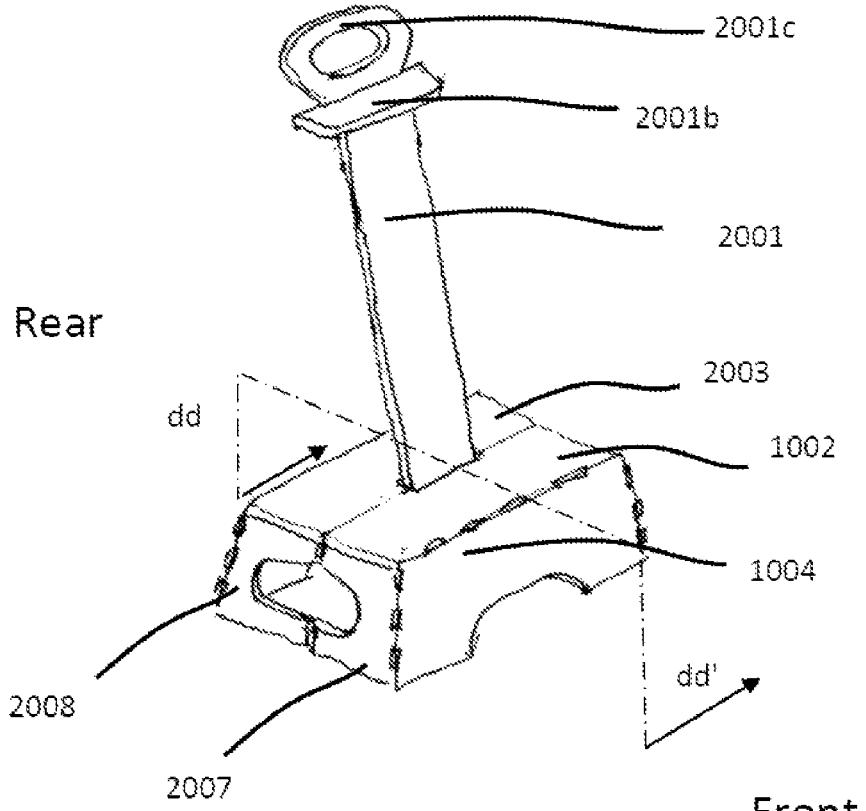
FIG. 19 shows an ISO view of the first alternate embodiment of the present invention 2000 at its opened stage, according to embodiments of the present invention disclosed herein.
Figure 21:
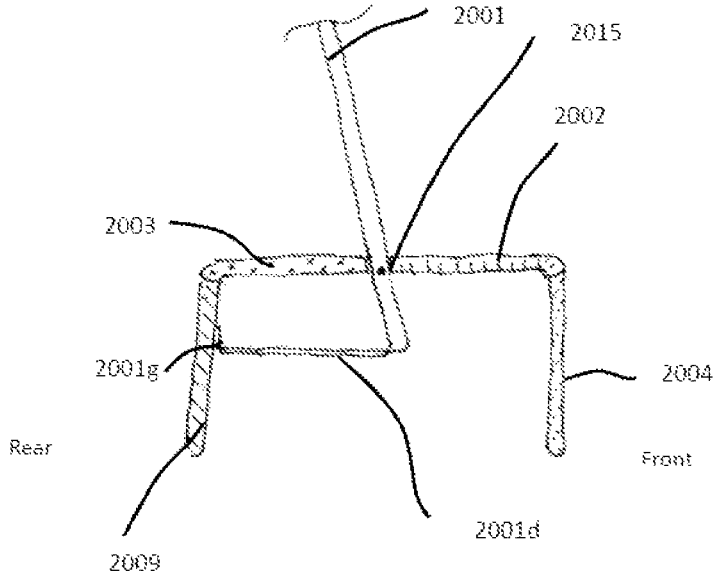
FIG. 21 shows a cross section of dd-dd' shown in FIG. 19 of the first alternate embodiment of the present invention at its opened stage, according to embodiments of the present invention disclosed herein.
Figure 22:
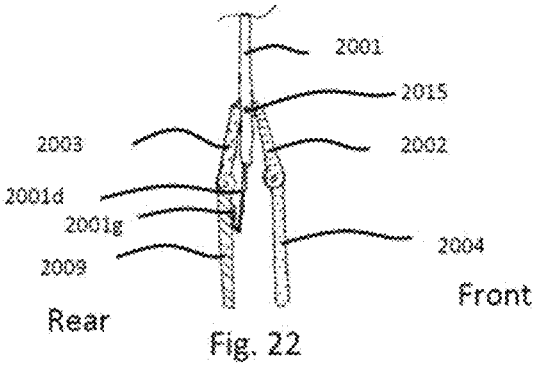
FIG. 22 shows a cross section of cc-cc' shown in FIG. 18 of the first alternate embodiment of the present invention at its folded stage, according to embodiments of the present invention disclosed herein.
Figure 24:
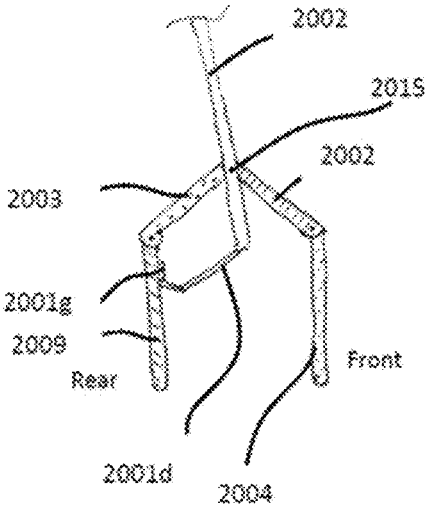
FIG. 24 shows a cross section shown of the first alternate embodiment of the present invention at work in progress between folded stage and opened stage at the same location as the cross-section cc-cc' in FIG. 18 shows, according to embodiments of the present invention disclosed herein.

The first alternate embodiment of the present invention consists of the long handle 2001, the front top members 2002, the rear top member 2003, a rear member 2009, two right side members 2005, 2006 and two left side members 2007, 2008 as shown in FIG. 19 and FIG. 21.

The front top member 2002 and the rear top member 2003 are connected with a pin or some type of hinge mechanisms.

The front top members 2002, the rear top member 2003, the front member 2004 and the rear member 2009 are connected with a pin or some type of hinge mechanisms.

The front member 2004, the rear member 2009, right side members 2005/2006 and the left side members 2007/2008 are connected with a pin or some type of hinge mechanisms.

Figure 20:
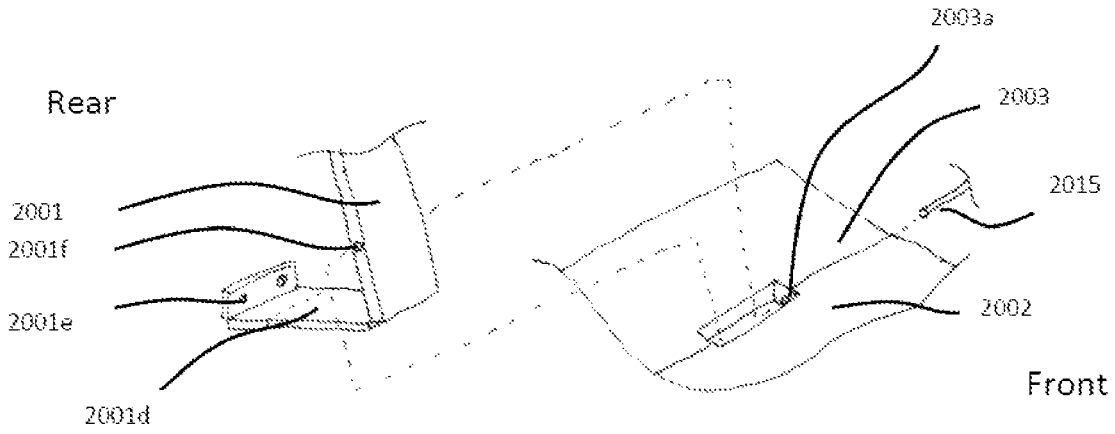
FIG. 20 shows an ISO view of the linkage mechanism inside the stool and the top members of the first alternate embodiment of the present invention, according to embodiments of the present invention disclosed herein.
Figure 23:
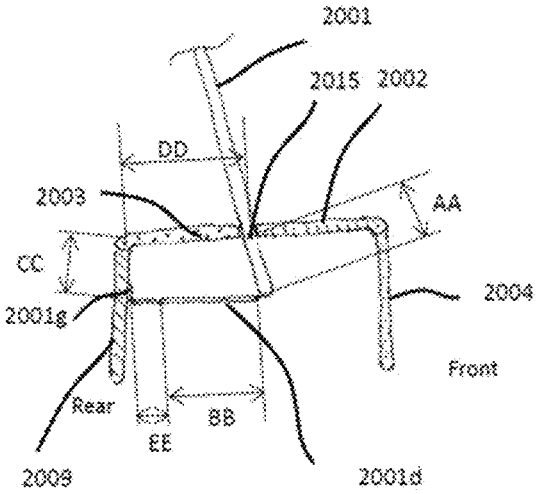
FIG. 23 shows a cross section of dd-dd' shown in FIG. 19 of the first alternate embodiment of the present invention at its opened stage, according to embodiments of the present invention disclosed herein.

The handle 2001, the front top member 2002 and the rear top member 2003 are connected with the pin(s) 2015 as shown in FIG. 19, FIG. 20 and FIG. 21. The mounting tab 2001*g* in FIG. 21 and FIG. 23 is attached to the rear member 2009 with a pin(s) or other known method in the industry.

Intended material used for the first embodiment of the present invention 2000 includes, but not limited to some type of plastic.

Figure 25:
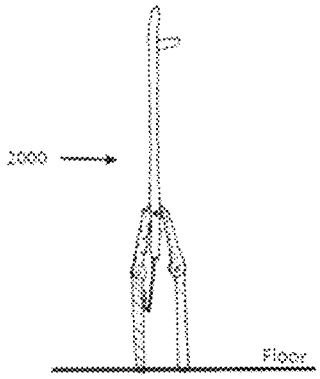
FIG. 25 shows a cross section cc-cc' of the ISO view in FIG. 18 of the first alternate embodiment of the present invention on the floor.
Figure 26:
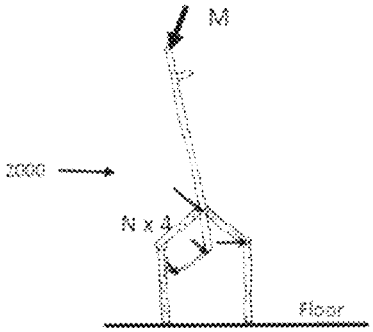
Figure 27:
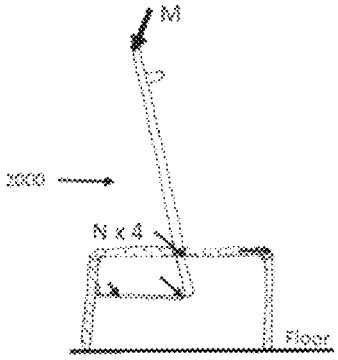

The following is the relative formula for the link mechanism in the preferred embodiment of the present invention 2000. Distance AA+BB−EE=CC+DD The linkage plate 2001*d* may be connected with living hinge with the main part of the handle 2001. Or the linkage plate 2001*d* may be a separate piece made of plastic or some type of flexible material. FIG. 25 through FIG. 27 show the progress of opening of the first alternate embodiment of the present invention 2000. Pivot points of the present invention 2000 move as arrows N×4 indicate when force M is applied to the handle as shown in FIG. 26 and FIG. 27.

Figure 28:
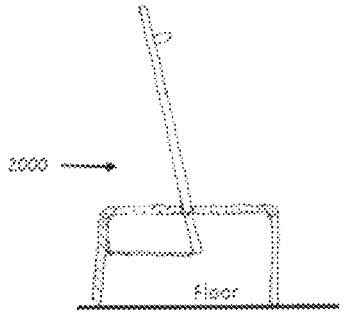
FIG. 28 shows a cross section of the ISO view of dd-dd' in FIG. 19 of the first alternate embodiment of the present invention on the floor.
Figure 29:
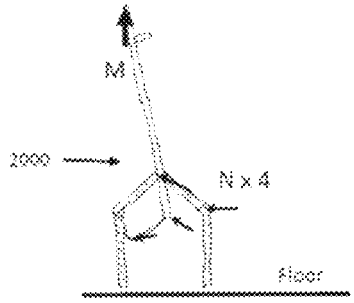
Figure 30:
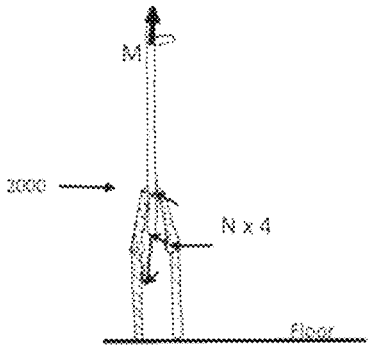
Figure 31:
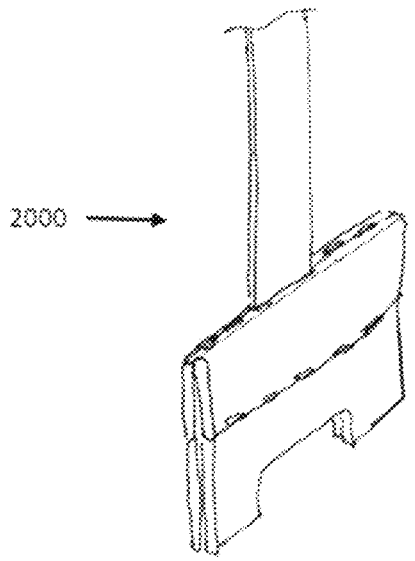
FIG. 31 through 33. Show the ISO views of the first alternate embodiment of the present invention in different stages, closed (FIG. 31), opened (FIG. 33) and opening in progress (FIG. 32), according to embodiments of the present invention disclosed herein.
Figure 32:
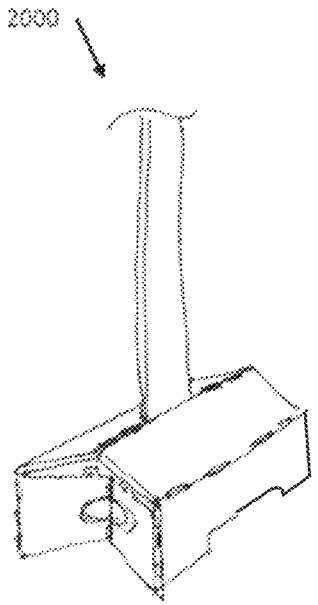
Figure 33:
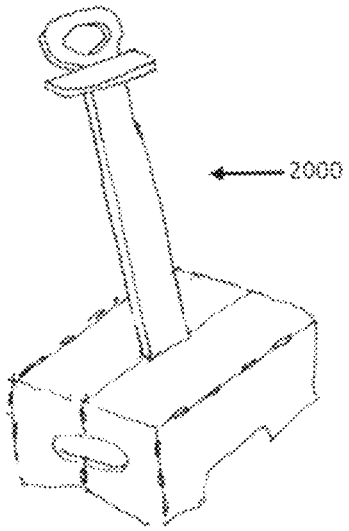
Figure 34:
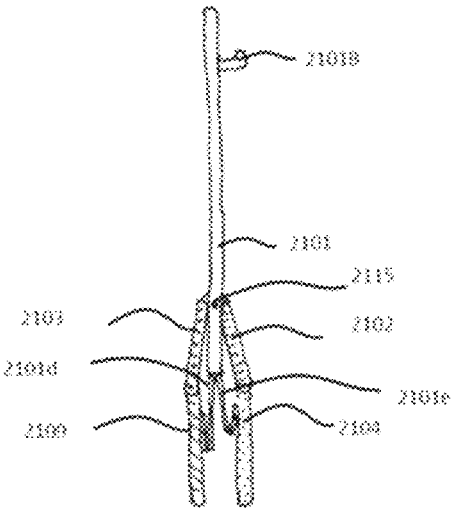
FIG. 34 shows a cross section of cc-cc' shown in FIG. 18 of the first alternate embodiment of the present invention at its folded stage. This variation has an added feature for the handle to stay at the frontward position which the first alternate embodiment of the present invention does not have, according to embodiments of the present invention disclosed herein.
Figure 35:
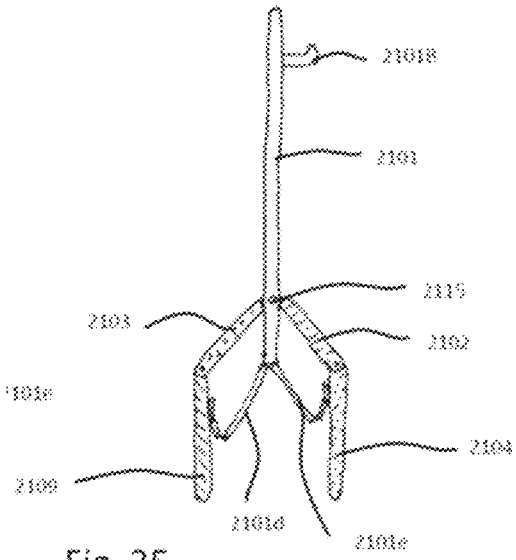
FIG. 35 shows a cross section shown of the first alternate embodiment of the present invention at work in progress between folded stage and opened stage at the same location as the cross-section cc-cc' in FIG. 18 shows. This variation has an added feature for the handle to stay at the frontward position which the first alternate embodiment of the present invention 2000 does not have, according to embodiments of the present invention disclosed herein.

Referring to FIG. 28 through FIG. 30 show the progress of folding of the present invention. Pivot points of the present invention move as arrows N×4 indicate when force M is applied to the handle as shown in FIG. 29 and FIG. 30.

Figure 36:
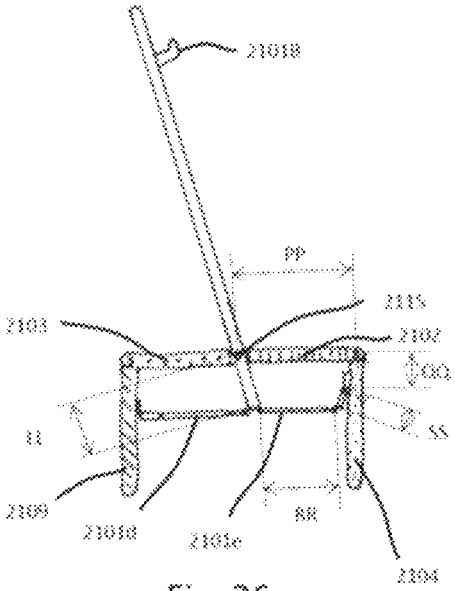
FIG. 36 shows a cross section of dd-dd' shown in FIG. 19 of the first alternate embodiment of the present invention at its opened stage. This variation has an added feature for the handle to stay at the frontward position which the first alternate embodiment of the present invention does not have, according to embodiments of the present invention disclosed herein.
Figure 37:
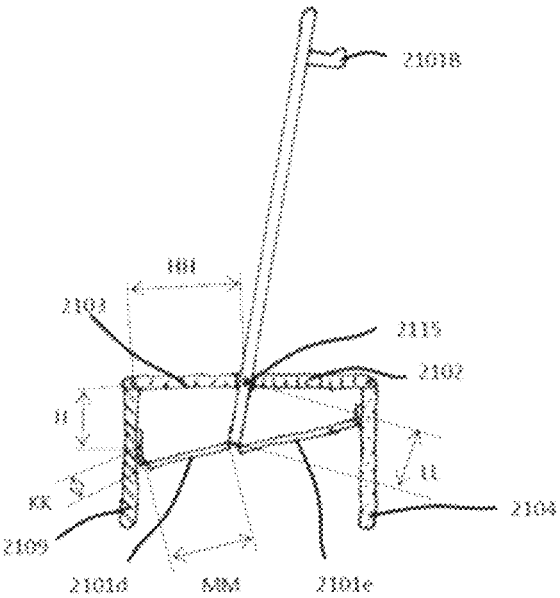
FIG. 37 shows a cross section of dd-dd' shown in FIG. 19 of the first alternate embodiment of the present invention at its opened stage. This variation has an added feature for the handle to stay at the frontward position which the first alternate embodiment of the present invention does not have. Only difference from FIG. 36 is that the handle stays at the frontward position, according to embodiments of the present invention disclosed herein.
Figure 38:
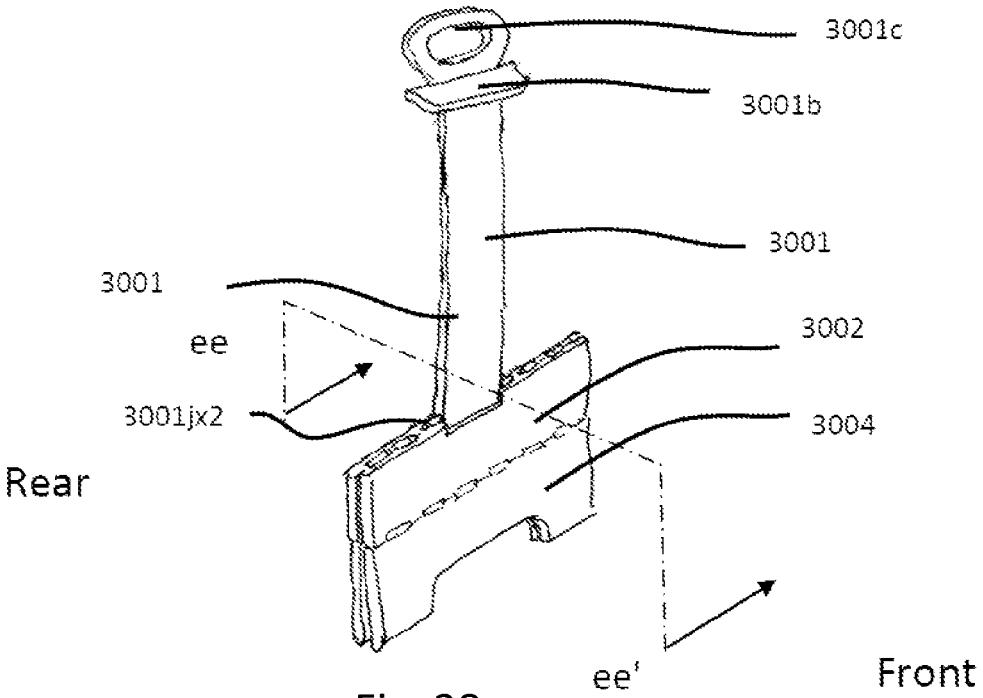
FIG. 38 shows an ISO view of the second alternate embodiment of the present invention at its folded stage, according to embodiments of the present invention disclosed herein.

The following is the relative formula for the link mechanism in the preferred embodiment of the present invention 2000 with added linkage which allows the handle to stay at the frontward position. Distance PP+QQ+SS=LL+RR as shown in FIG. 36. Distance HH+JJ+KK=MM+LL as shown in FIG. 37.

Figure 39:
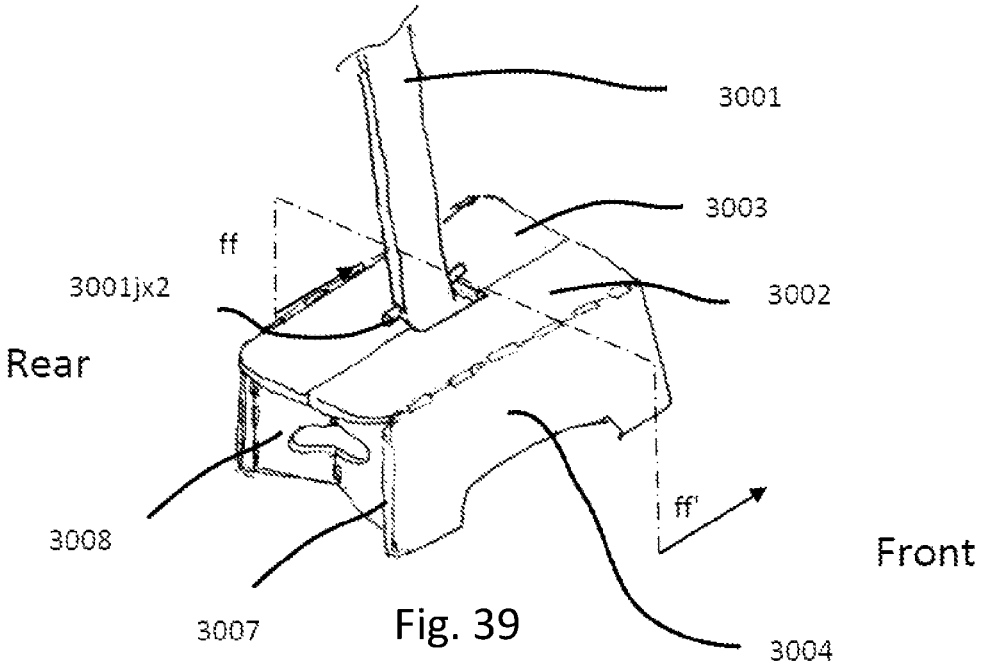
FIG. 39. shows an ISO view of the second alternate embodiment of the present invention at its opened stage, according to embodiments of the present invention disclosed herein.
Figure 43:
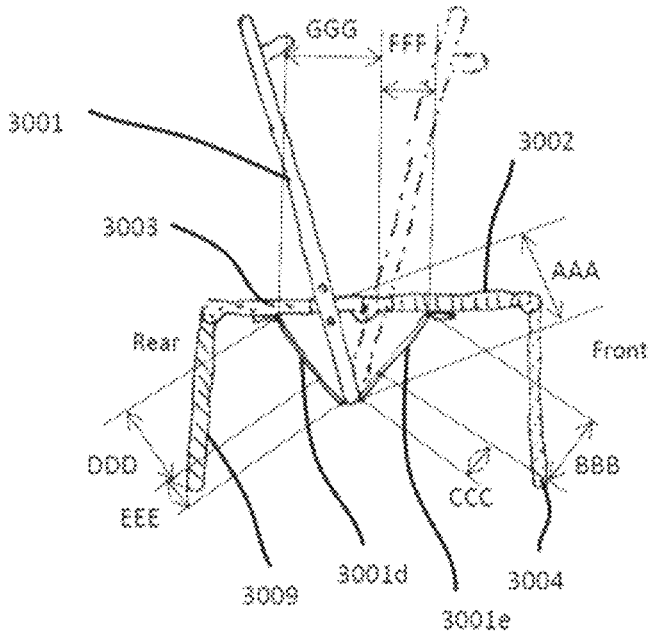
FIG. 43 shows a cross section ff-ff in the ISO view in FIG. 39 of the second alternate embodiment of the present invention at its opened stage, according to embodiments of the present invention disclosed herein.

The second alternate embodiment of the present invention 3000 consists of a long handle 3001, the front top members 3002, the rear top member 3003, a rear member 3009, the right-side members 3005, 3006 and the left side members 3007, 3008 as shown in FIG. 39 and FIG. 43.

The front top members 3002, the rear top member 3003, the front member 3004 and the rear member 3009 are connected with a pin or some type of hinge mechanisms. The front members 3004, the rear member 3009, right side members 3005, 3006 and the left side members 3007, 3008 are connected with a pin or some type of hinge mechanisms.

Figure 40:
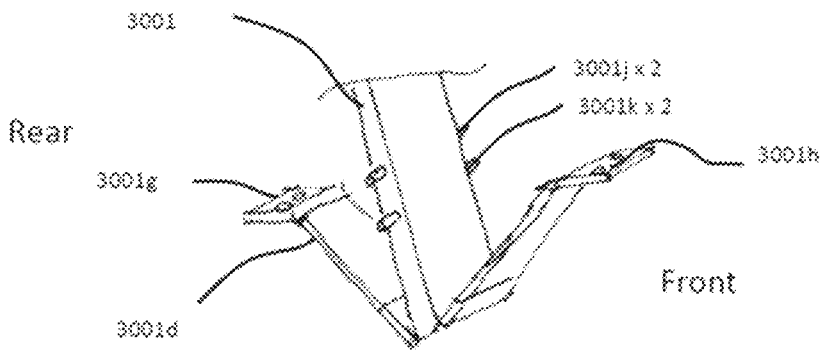
FIG. 40 shows an ISO view of the linkage mechanism inside the stool of the second alternate embodiment of the present invention, according to embodiments of the present invention disclosed herein.

The handle 3001 has upper pins 3001*j*×2 and lower pins 3001*k*×2 on its side edges as shown in FIG. 40. The rear top member is located between the upper pins 3001*j*×2 and lower pins 3001*k*×2 as shown in FIG. 39 and FIG. 41.

Figure 41:
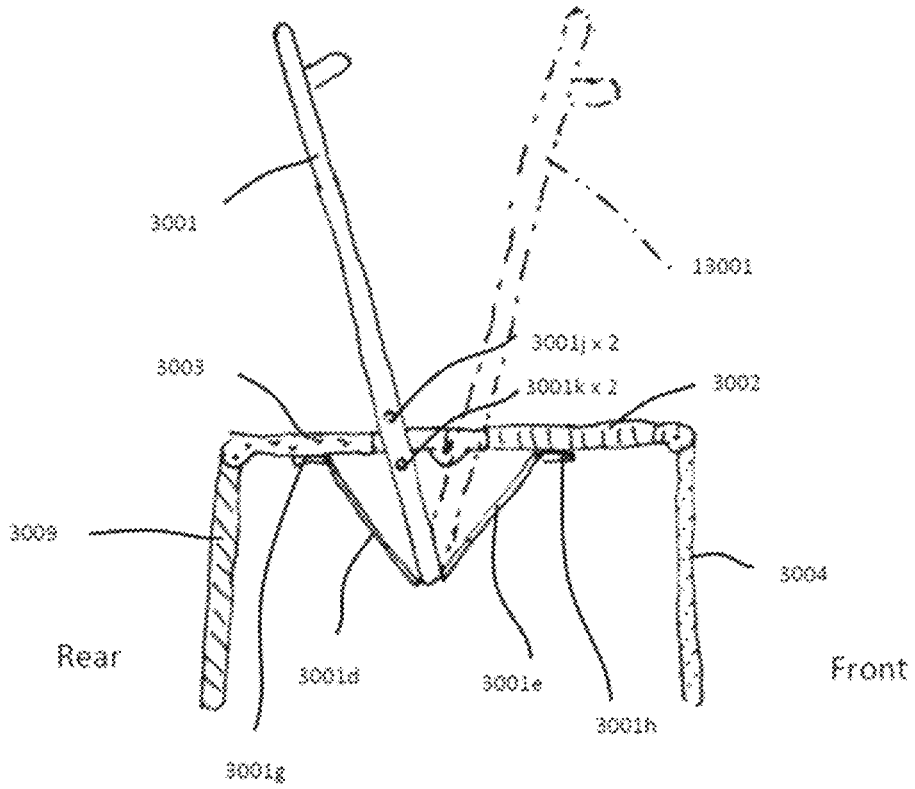
FIG. 41 shows a cross section of ff-ff' shown in FIG. 39 of the second alternate embodiment of the present invention at its folded stage, according to embodiments of the present invention disclosed herein.
Figure 42:
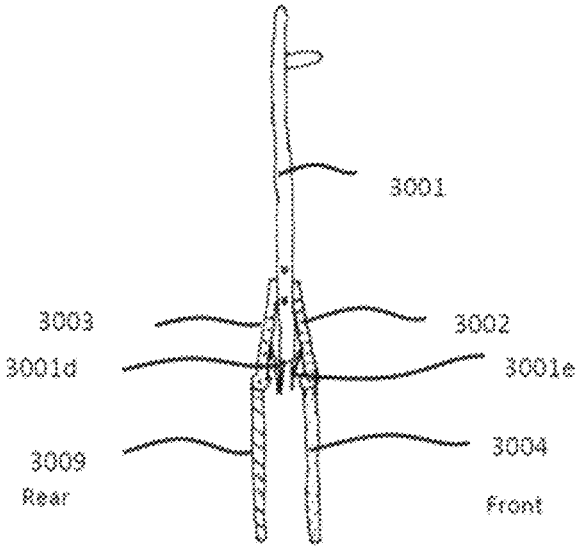
FIG. 42 shows a cross section of ee-ee' shown in FIG. 38 of the second alternate embodiment of the present invention 3000 at its opened stage, according to embodiments of the present invention disclosed herein.
Figure 44:
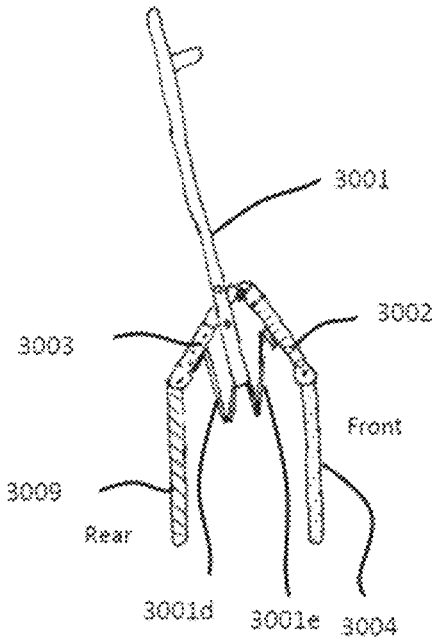
FIG. 44 shows a cross section of the second alternate embodiment of the present invention at work in progress between folded stage and opened stage at the same location as the cross-section ff-ff' in FIG. 39 shows, according to embodiments of the present invention disclosed herein.

The mounting tab 3001*g* is attached to the rear top member 3003 with a pin(s) or other known method in the industry as shown in FIG. 41. The mounting tab 3001*h* is attached to the front top member 3002 with a pin(s) or other known method in the industry as shown in FIG. 41. The tabs 3001*g*, 3001*h* may be attached to the rear member 3009 and 3004.

Intended material used for the second alternate embodiment of the present invention 3000 includes, but not limited to some type of plastic.

The following is the relative formula for the link mechanism in the preferred embodiment of the present invention 3000. Distance AAA=distance FFF+BBB−CCC=distance GGG+DDD−EEE The linkage plates 3001*d*, 3001*e* may be connected with living hinge with the main part of the handle 3001. Or the linkage plates may be a separate piece made of plastic or some type of flexible material.

Figure 45:
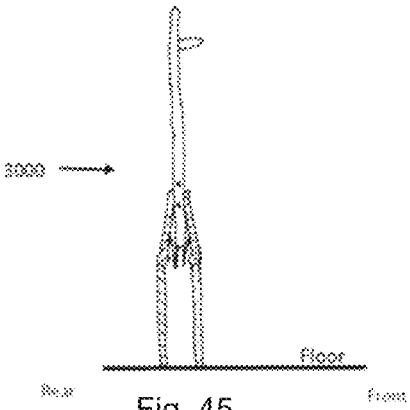
FIG. 45 shows a cross section ee-ee' in the ISO view in FIG. 38 of the second alternate embodiment of the present invention on the floor, according to embodiments of the present invention disclosed herein.
Figure 46:
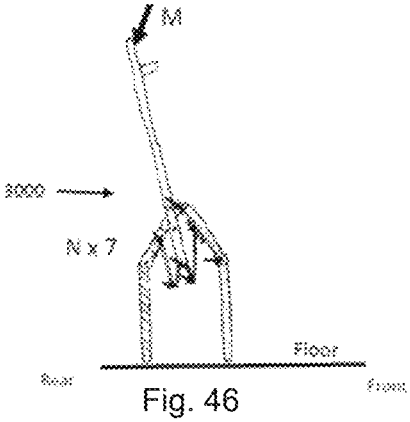
FIG. 46 shows a cross section of the second alternate embodiment of the present invention opening in progress with arrows to indicate the movement of each pivot points. Shown stage is between folded stage shown in FIG. 45 and opened state in FIG. 47 according to embodiments of the present invention disclosed herein.
Figure 47:
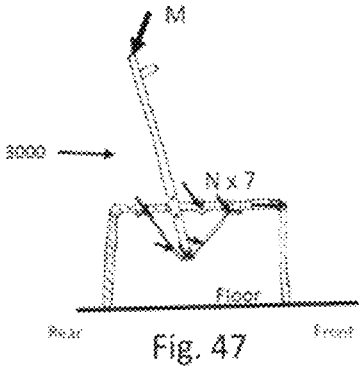
FIG. 47 shows a cross section ff-ff' of the ISO view in FIG. 39 of the second alternate embodiment of the present invention opened with arrows to indicate the movements of each pivotal points, according to embodiments of the present invention disclosed herein.

FIG. 45 through FIG. 47 show the progress of opening of the second alternate embodiment of the present invention 3000. Pivot points of the present invention move as arrows N×7 indicate when force M is applied to the handle as shown in FIG. 26 and FIG. 47.

Figure 48:
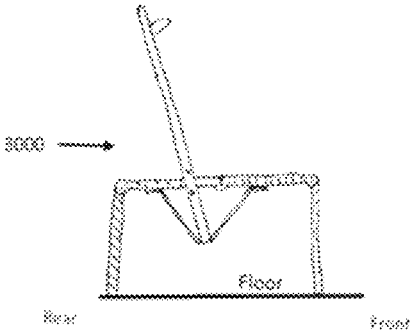
FIG. 48 shows a cross section of the ISO view of ff-ff' in FIG. 39 of the second alternate embodiment of the present invention on the floor.
Figure 49:
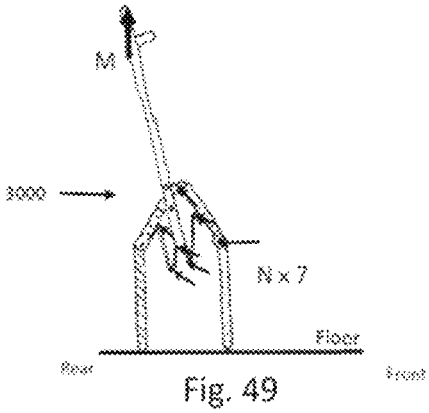
Figure 50:
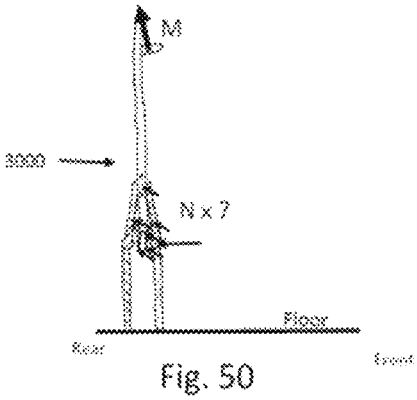
Figure 51:
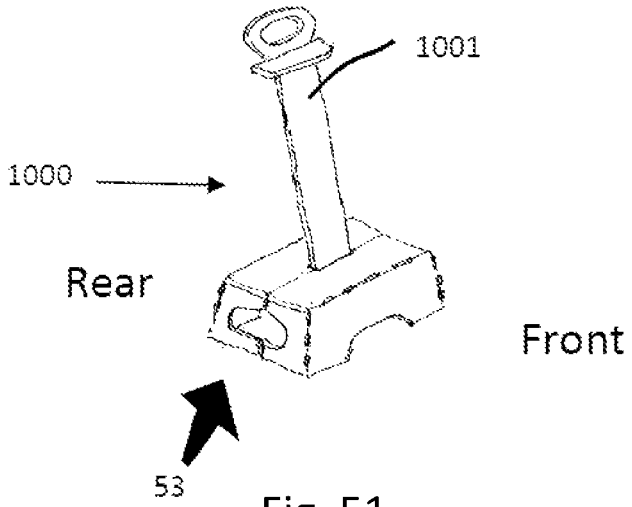
FIG. 51 shows an ISO view of the preferred embodiment of the present invention with arrow 53, according to embodiments of the present invention disclosed herein.

FIG. 48 through FIG. 50 show the progress of folding of the present invention. Pivot points of the present invention move as arrows N×7 indicate when force M is applied to the handle as shown in FIG. 48 and FIG. 50.

The preferred embodiment 1000, the first embodiment 2000 and the second embodiment 3000 of the present invention have a lock mechanism which keeps the stool at opened stage even when the handle is lifted, and entire device is hung above the floor.

Figure 52:
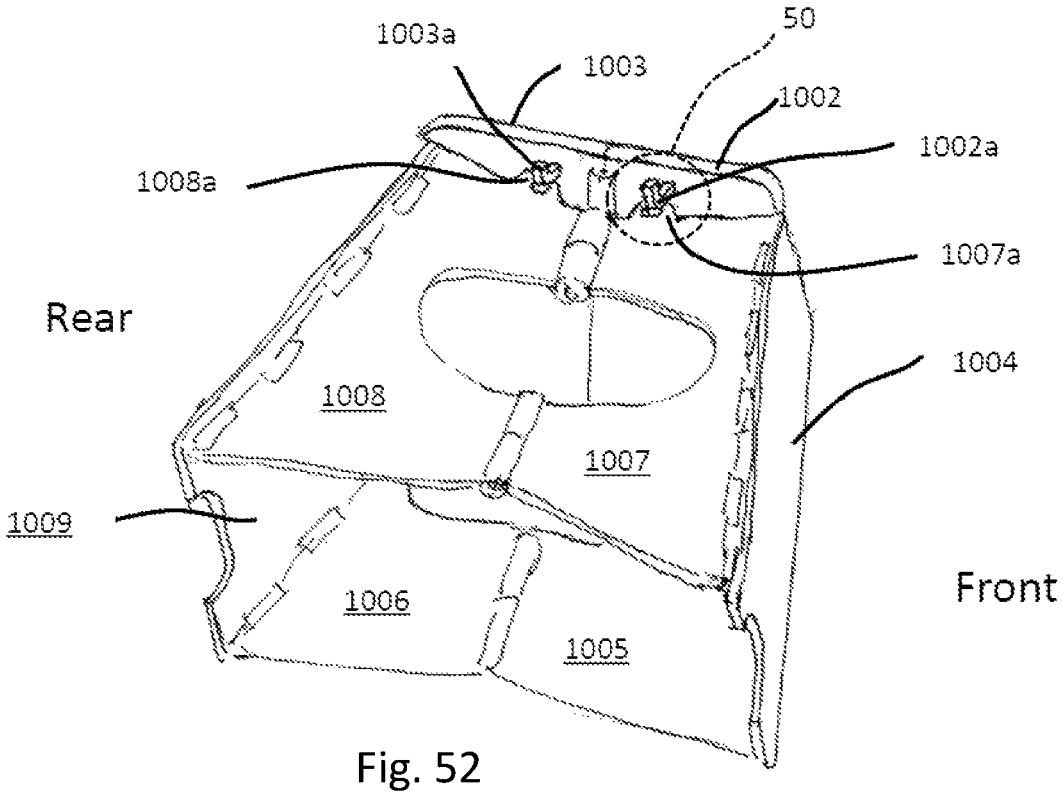
FIG. 52 shows an ISO view of the preferred embodiment of the present invention 1000 with an angle as the arrow 53 indicated in FIG. 51. The circle 50 shows a mechanism. The mechanisms lock and keep the stool at opened stage when the handle 1001 is pulled up in the air, according to embodiments of the present invention disclosed herein.

FIG. 52 shows an ISO view of the stool. The tabs 1008*a*, 1007*a* and the hooks 1003*a* and 1002*a* enables the locking feature.

Figure 53:
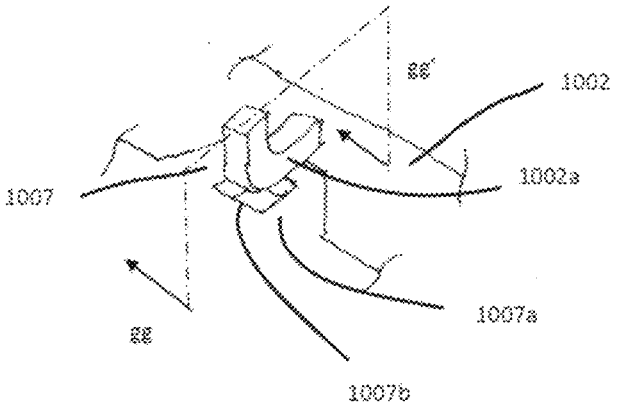
FIG. 53 shows an enlarged ISO view of the circled area with dotted line 50 in FIG. 52. It shows the stool lock mechanism with free position, according to embodiments of the present invention disclosed herein.

FIG. 53 shows an enlarged view of the circle 50 in FIG. 52.

Figure 54:
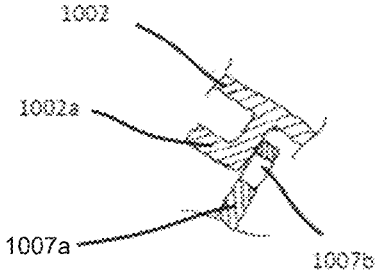
FIG. 54 shows a cross section gg-gg' in FIG. 53, according to embodiments of the present invention disclosed herein.
Figure 57:
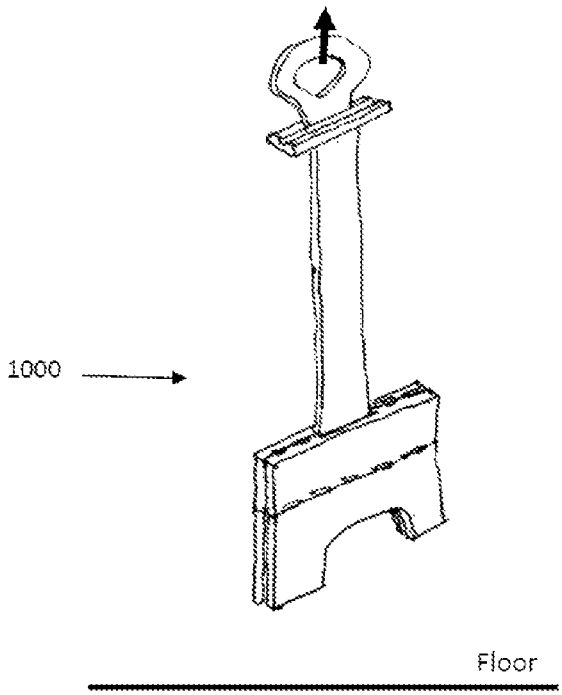
FIG. 57 shows an ISO view of the preferred embodiment of the present invention 1000 with the stool lock mechanism with free position, according to embodiments of the present invention disclosed herein.

The condition in FIG. 53, FIG. 54 is free condition. It means the stool will automatically folds when the handle 1001 is lifted, and the entire stool is hung above the floor as shown in FIG. 57. The hook 1007*a* is not engaged in the hole 1007*b*.

Figure 55:
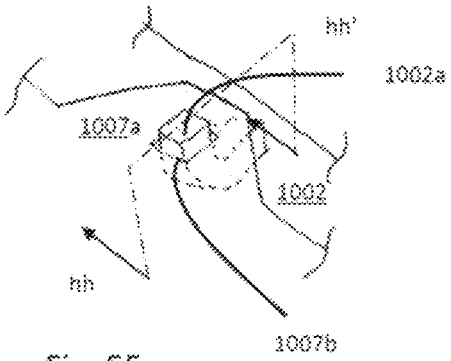
FIG. 55 shows an ISO view of the stool with locked position, according to embodiments of the present invention disclosed herein.
Figure 56:
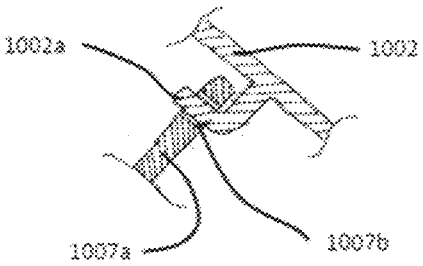
FIG. 56 shows a cross section hh-hh' in FIG. 55 according to embodiments of the present invention disclosed herein.
Figure 58:
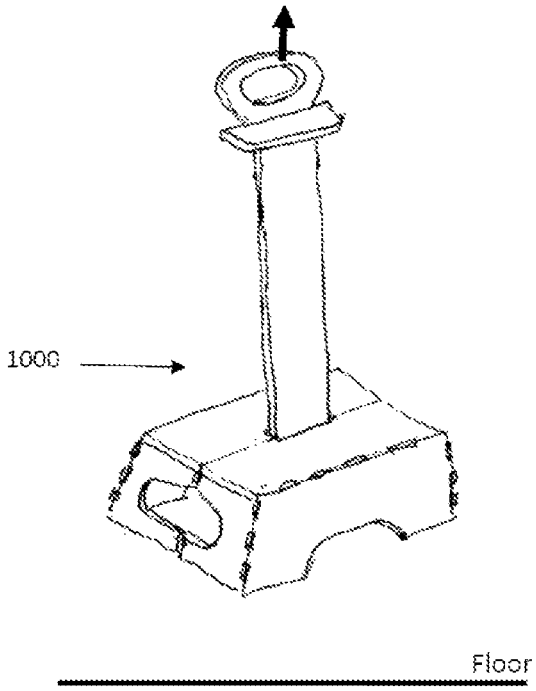
FIG. 58 shows an ISO view of the preferred embodiment of the present invention 1000 with the stool lock mechanism with locked position, according to embodiments of the present invention disclosed herein.
Figure 59:
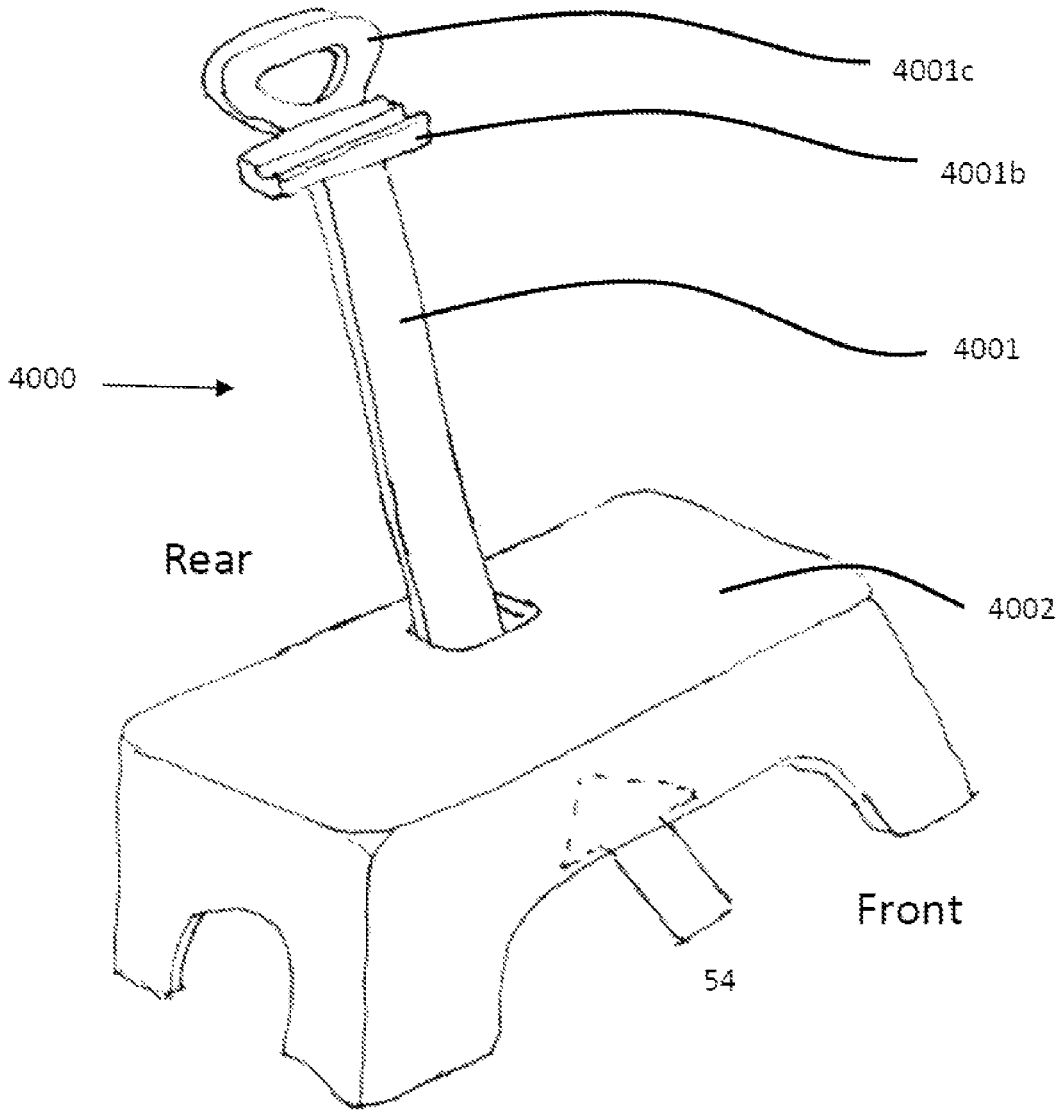
FIG. 59 shows and ISO view of the third alternate embodiment of the present invention 4000, according to embodiments of the present invention disclosed herein.
Figure 60:
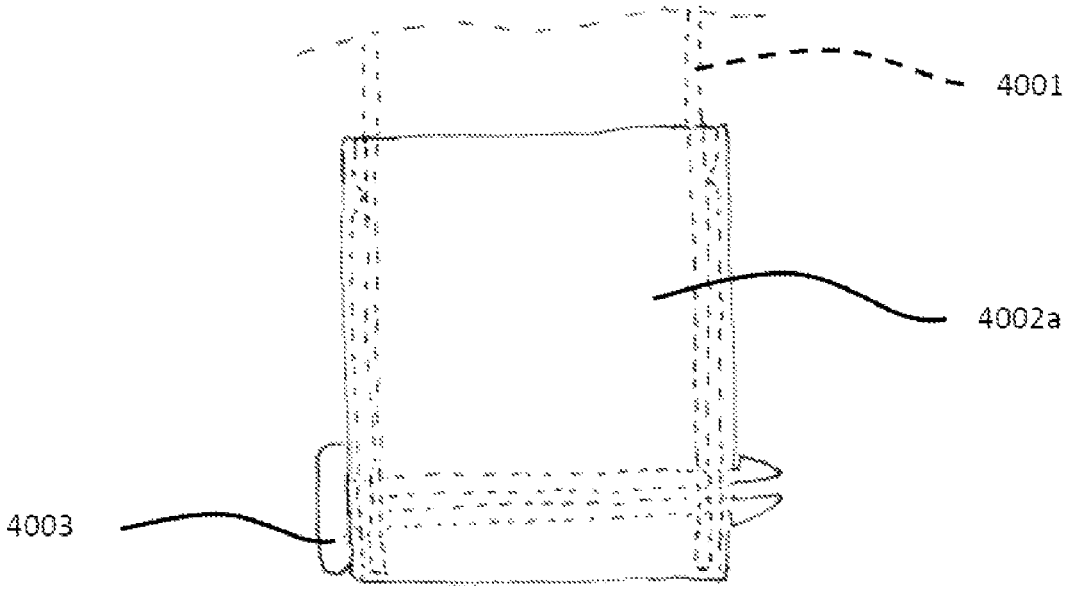
FIG. 60 shows a front view of the handle base at an angle as an arrow 54 in FIG. 59 points out, according to embodiments of the present invention disclosed herein.

The condition in FIG. 55, FIG. 56 is locked condition. It means the stool will stay opened even when the handle is lifted, and the entire stool is hung above the floor as shown FIG. 58. The hook 1007*a* is engaged in the hole 1007*b*. This feature provides improved convenience when the stool is used with frequent move around.

The same concept of locking tab 1007*a* and the hole 1007*b* on the side member 1007 may be applied to other side members 1008, 1005 and/or 1006. The same concept of the hook 1002 and the hook 1002*a* on the top front member 1002 may be applied to the other end of the top front member 1002 and/or on the top rear member 1003.

The rear members 1009, 2009 and 3009 may be longer than the front members 1004, 2004 and 3004 on the preferred embodiment, first alternate embodiment and second embodiment of the present inventions 1000, 2000 and 3000. It enables easier opening movement. It becomes more useful when the inventions are hung on a hook on the wall.

The third alternate embodiment of the present invention 4000 consists of the long handle 4001, the stool 4002 and the pin 4003 as shown in FIG. 59, FIG. 60, FIG. 63 and FIG. 64.

Intended material used for the third alternate embodiment of the present invention 4000 includes, but not limited to some type of plastic.

Figure 63:
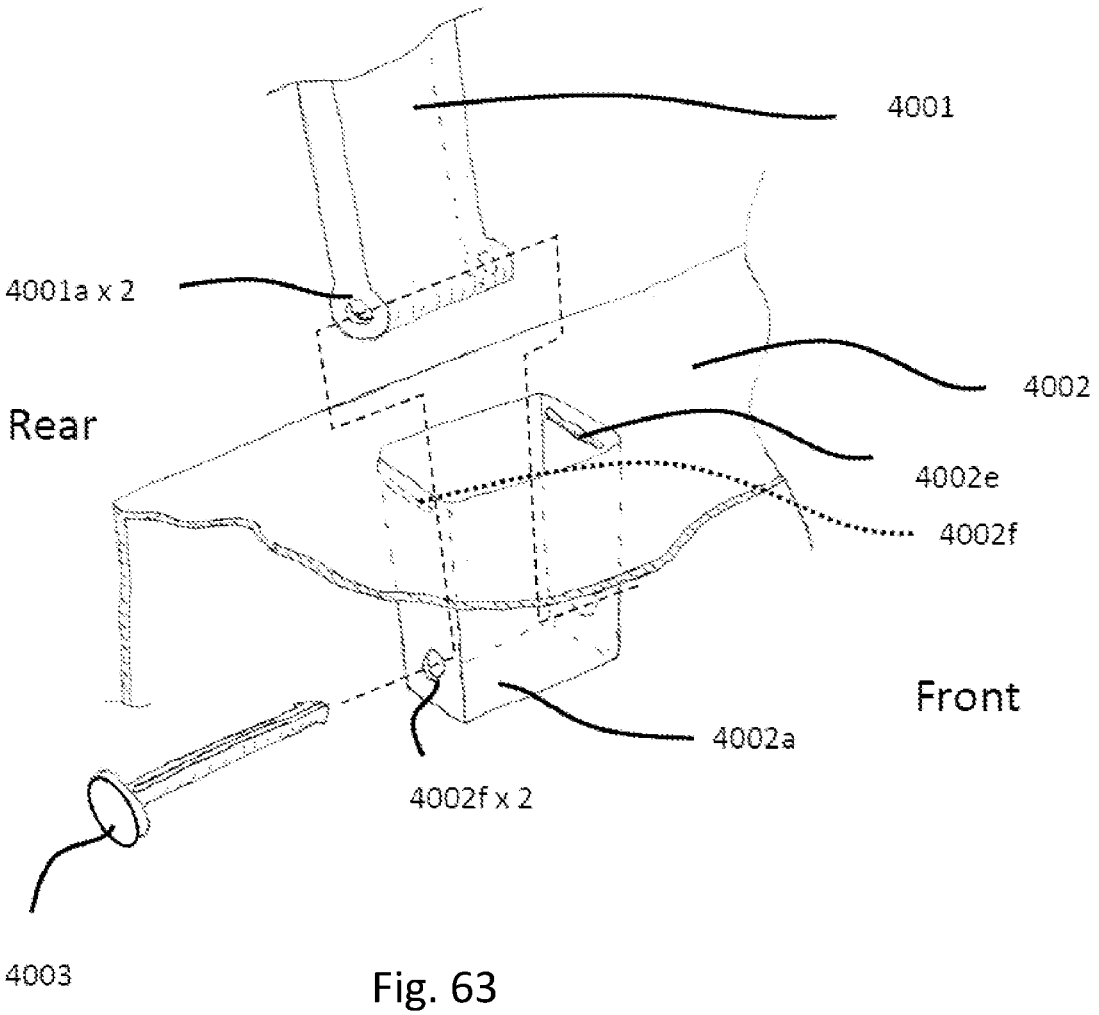
FIG. 63 shows an ISO view of the handle base and bottom of the handle of the third alternate embodiment of the present invention 4000, according to embodiments of the present invention disclosed herein.
Figure 64:
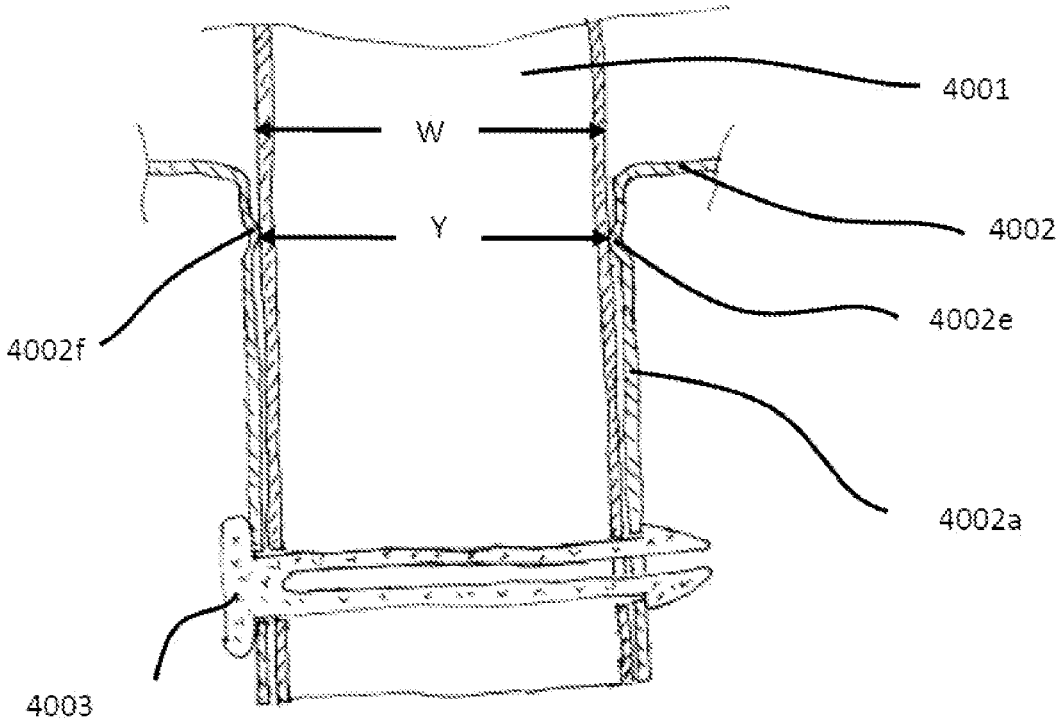
FIG. 64 shows a cross section of the handle base shown in FIG. 60. The cut section goes through the center of the pin 4003 in FIG. 64 vertically, according to embodiments of the present invention disclosed herein.
Figure 65:
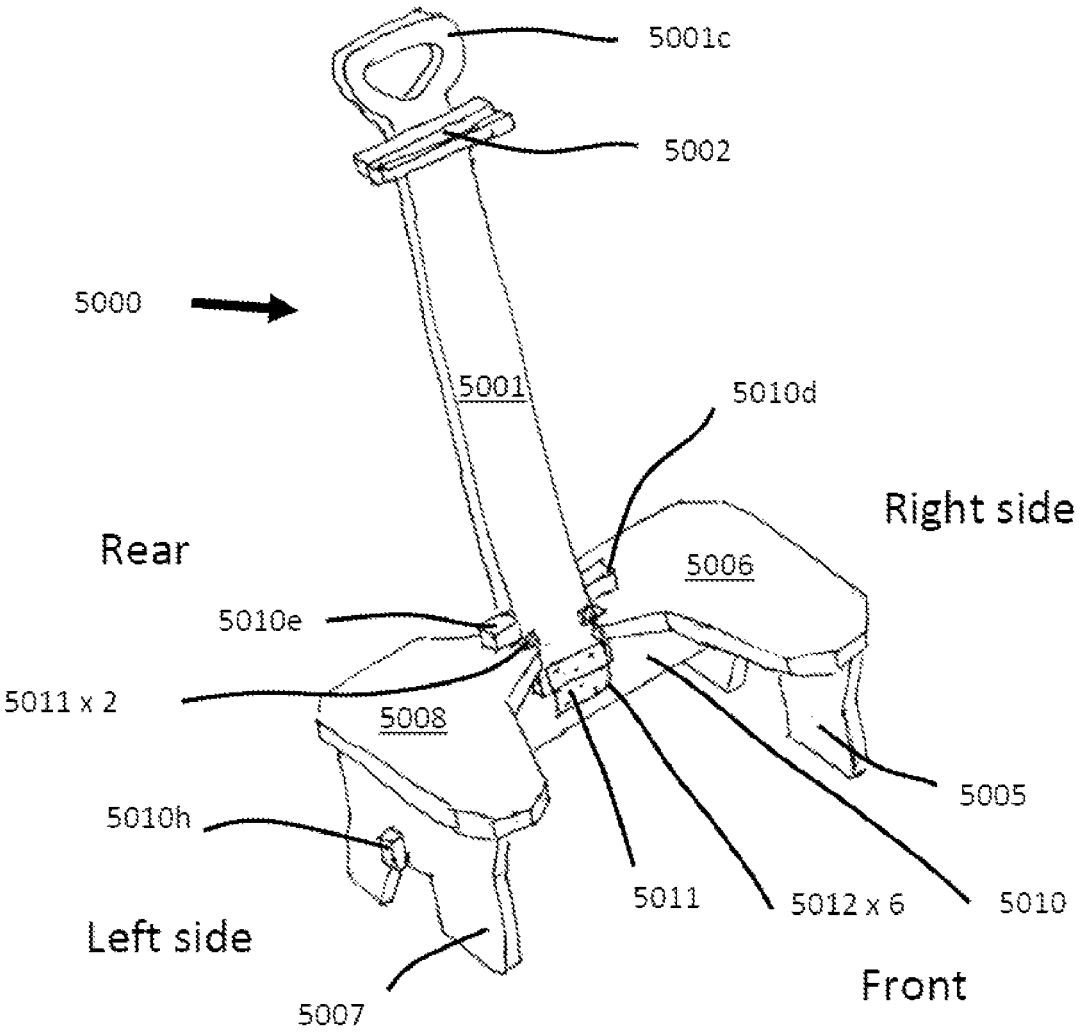
FIG. 65 shows an ISO view of the fourth alternate embodiment of the present invention 5000, according to embodiments of the present invention disclosed herein.

The distance W is wider than distance Y. Distance W is the width of the handle. Distance Y is the distance between the two bosses 4002*e*, 4002*f* in the handle base 4002*a* as shown in FIG. 63 and FIG. 64.

Figure 61:
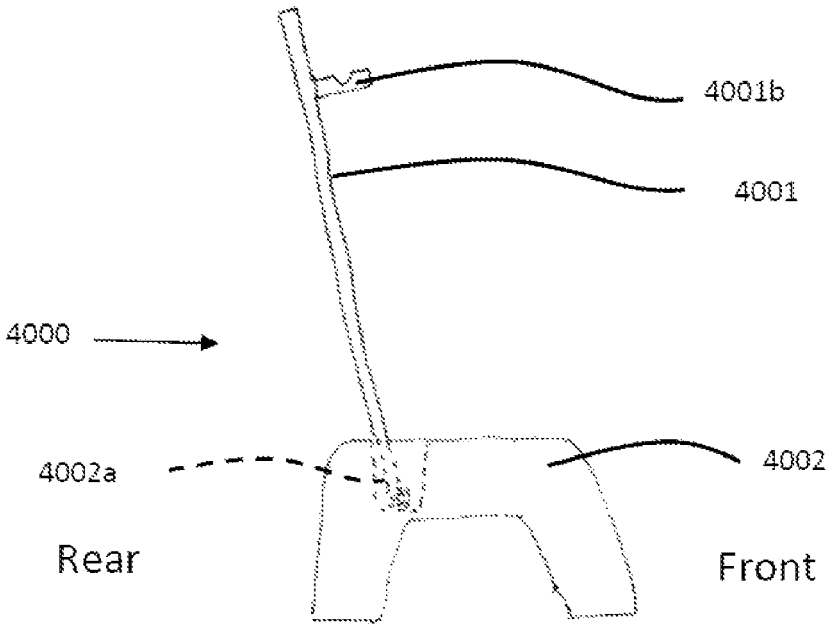
FIG. 61 shows the side view of the third alternate embodiment of the present invention 4000 with the handle at the rearmost position, according to embodiments of the present invention disclosed herein.
Figure 62:
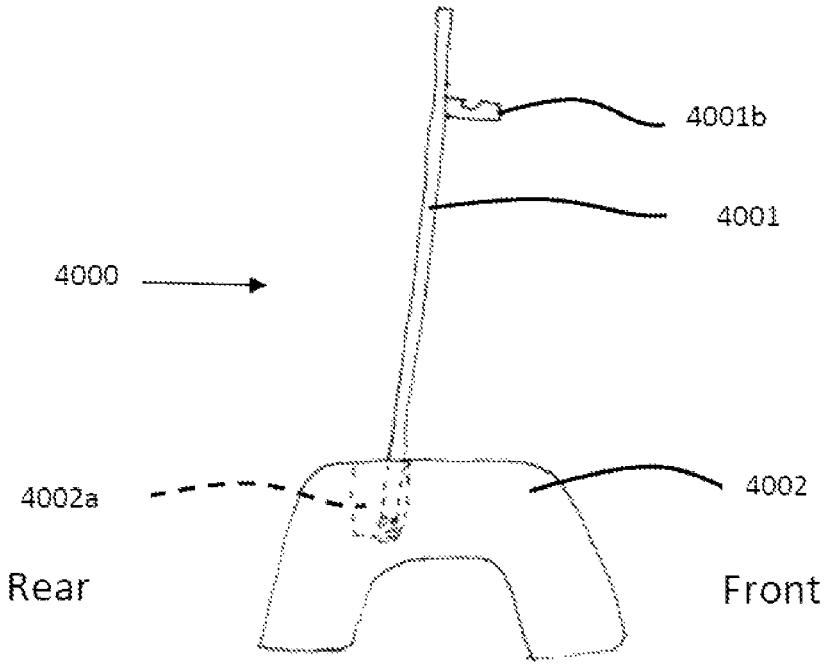
FIG. 62 shows the side view of the third alternate embodiment of the present invention 4000 with the handle at the frontmost position, according to embodiments of the present invention disclosed herein.

The handle 4001 may be set at the rearmost position as shown in FIG. 61. The handle 4001 may be set at the frontmost position as shown in FIG. 62. The handle 4001 may be set at any position between the rearmost position and frontmost position.

Figure 66:
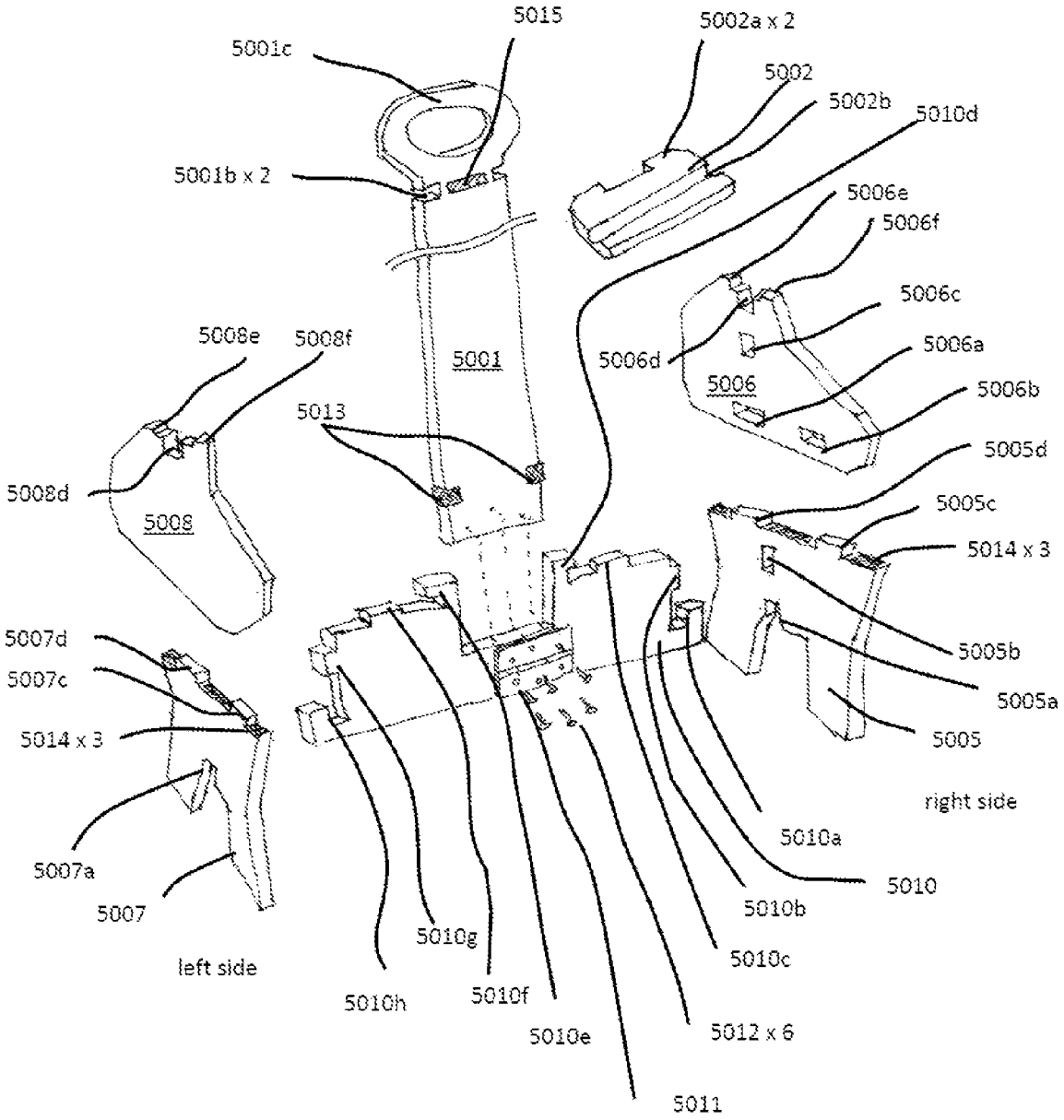
FIG. 66 shows an exploded ISO view of the fourth alternate embodiment of the present invention 5000, according to embodiments of the present invention disclosed herein.

The primary parts of the fourth alternate embodiment of the present invention 5000 consists of the handle 5001, the shelf 5002, the right top member 5006, the left top member 5008, the right leg 5005, the left leg 5007, the cross member 5010 and the hinge 5011 and screws 5012×6 as shown in the exploded view in FIG. 66.

Primary materials used for the fourth alternate embodiment of the present invention 5000 includes, but not limited to some type of plastic and wood.

Steps to assemble the primary parts for the fourth embodiment of the present invention 5000 may assemble the handle 5001 and the cross member 5010 with the hinge 5011 and screws 5012×6, Remove the wax paper from the adhesive tape 5014×6 and 5015×1, Engage the tenon 5010*a* and groove 5005*a*, Engage the tenon 5010*b* and mortise 5005*b*, Engage the tenon 5010*d* and groove 5006*d*, Engage the tenon 5010*c* and mortise 5006*c*, Engage the tenon 5005*d* and mortise 5006*a*, Engage the tenon 5005*c* and mortise 5006*b*, Repeat 2 through 8 for the left-hand side, Engage the tenons 5002*a*×2 and grooves 5001*b*×2, seen in FIG. 66.

Figure 67:
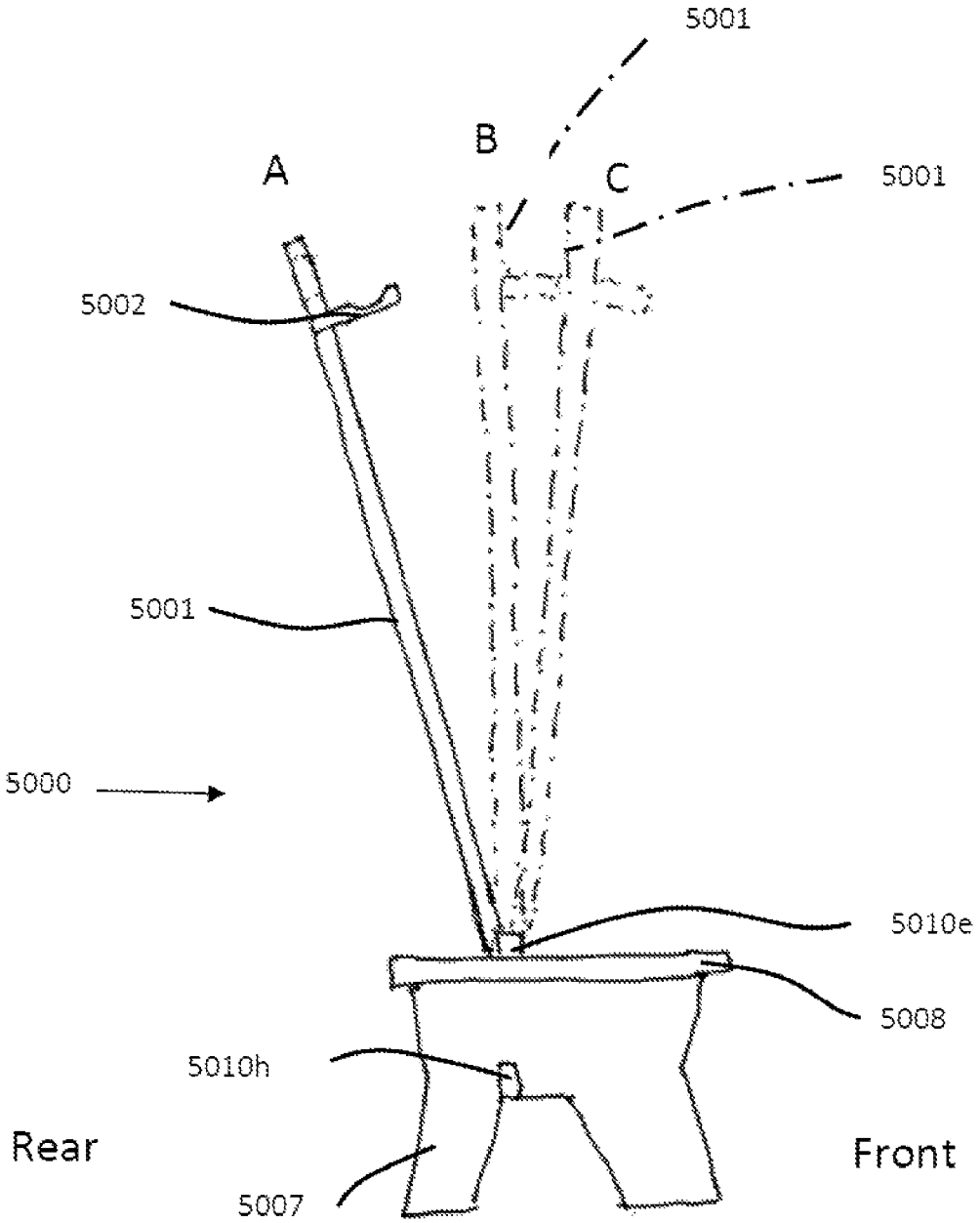
FIG. 67 shows a side view of the fourth alternate embodiment of the present invention 5000 with the handle at the rearmost position, the perpendicular position and the frontmost position, according to embodiments of the present invention disclosed herein.
Figure 68:
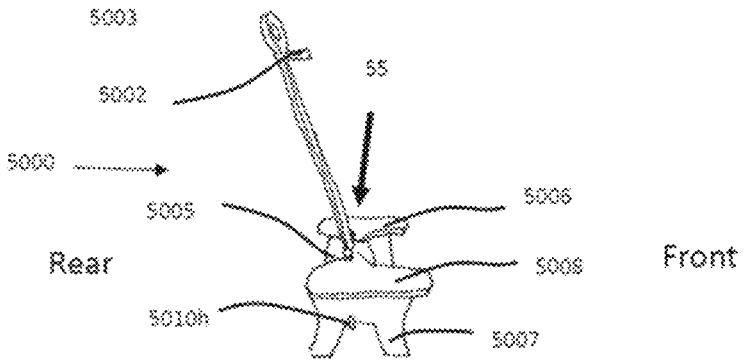
FIG. 68 shows an ISO view of the fourth alternate embodiment of the present invention 5000 with the handle at the rearmost position, according to embodiments of the present invention disclosed herein.

Adhesive tapes 5014×6 and #5015×1 shown in FIG. 66 may be replaced with other fastening method know in the industry including but not limited to glue, screws and hook and loop fasteners. FIG. 67 shows the moving range of the handle 5002 between the rearmost A position and the frontmost C position. B position is the perpendicular position.

Figure 69:
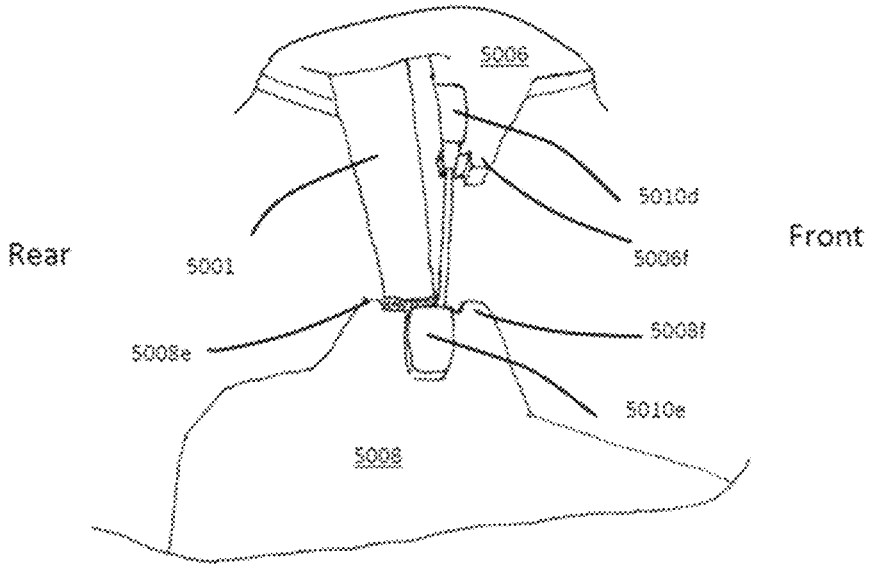
FIG. 69 shows an enlarged ISO view of the area where the arrow 55 in FIG. 68 points out, according to embodiments of the present invention disclosed herein.
Figure 70:
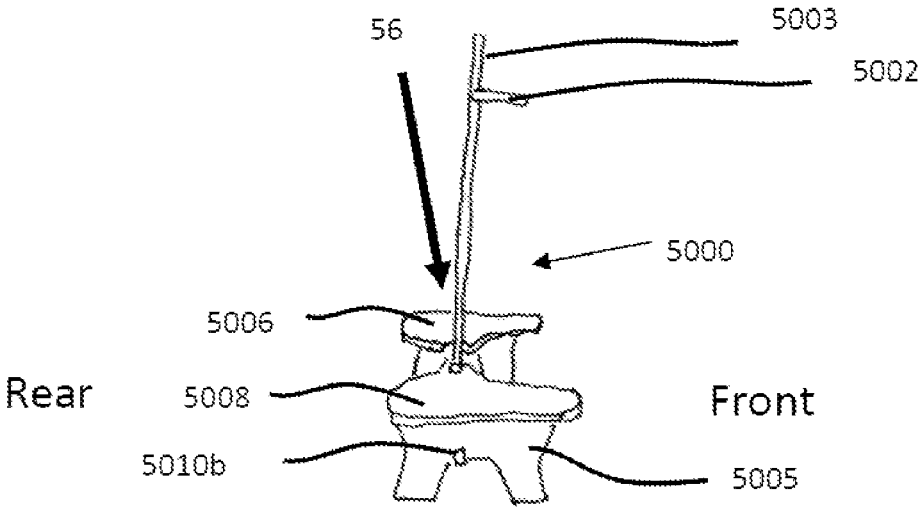
FIG. 70 shows an ISO view of the fourth alternate embodiment of the present invention 5000 with the handle at the frontmost position, according to embodiments of the present invention disclosed herein.

The handle 5001 stops when it contacts the rear stoppers 5008*e*, 5006*e* on the top members 5008/5006 as shown in FIG. 69. The handle 5001 can move only between the stoppers 5008*e* and 5008*f* as shown in FIG. 71.

The loop tapes 5013×2 are attached on the handle 5001 with adhesive or other known method in the industry. The loop tapes 5013×2 rubs against the edge of the inner edge of the tenon 5010*d*, 5010*e* and recessed area between the front stoppers 5006*f*, 5008*f* and rear stoppers 5006*e*, 5008*e*.

Figure 71:
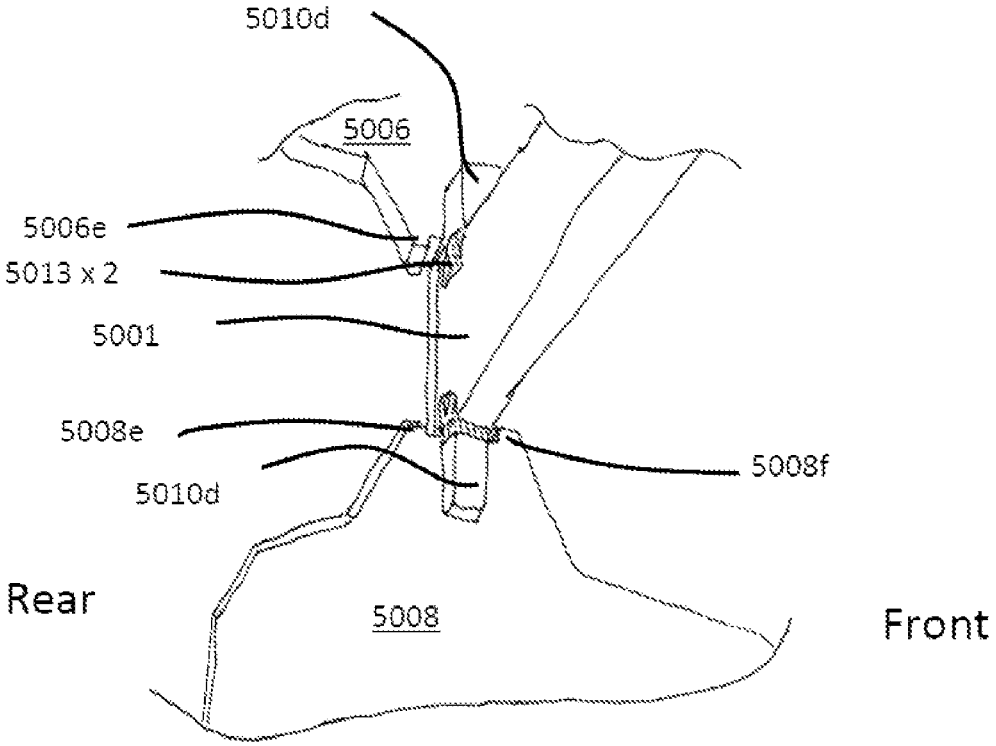
FIG. 71 shows an enlarged ISO view of the area where the arrow 56 in FIG. 70 points out, according to embodiments of the present invention disclosed herein.
Figure 72:
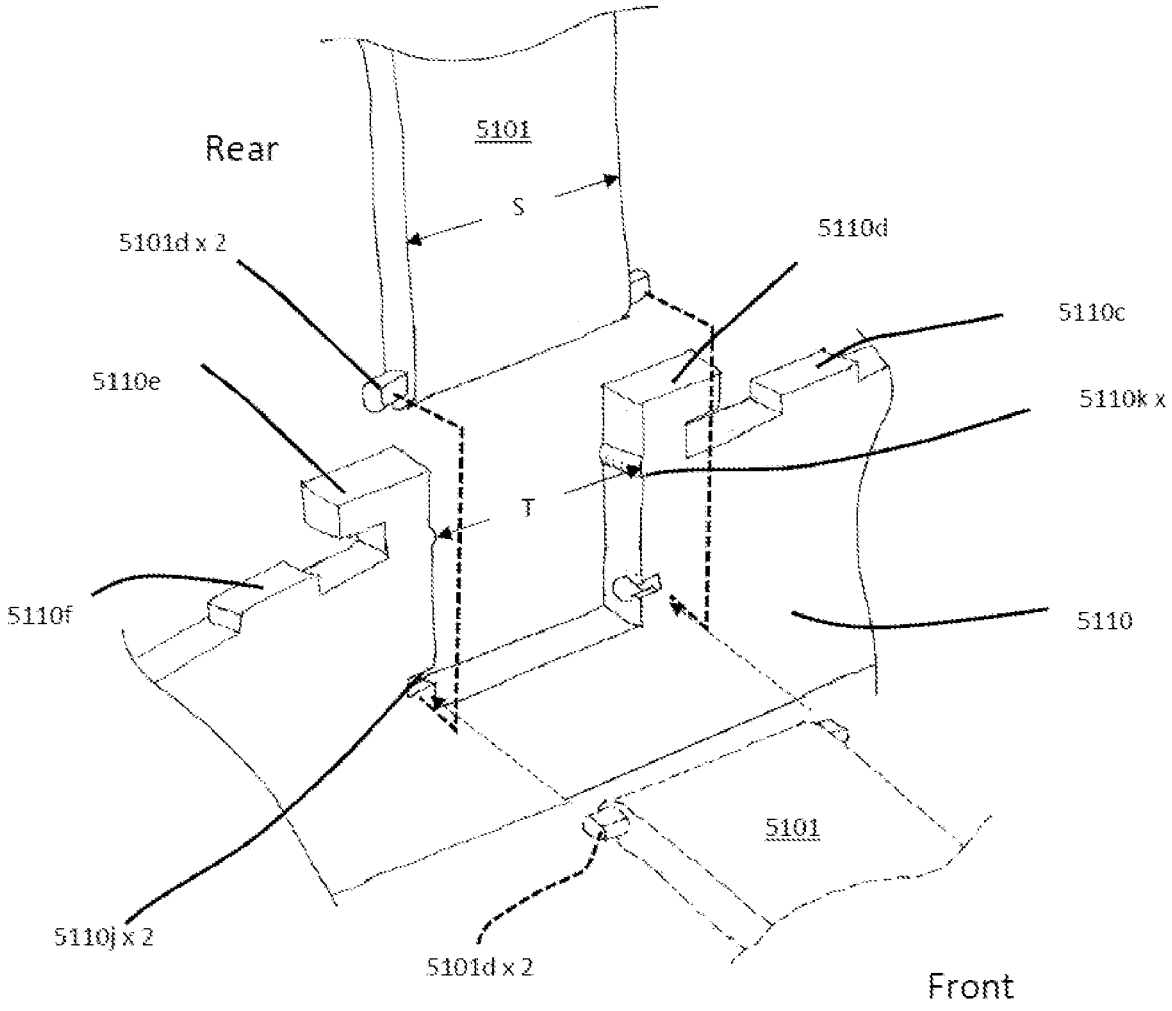
FIG. 72 shows an ISO view of the first alternate design of the hinge mechanism for the fourth alternate embodiment of the present invention 5000, according to embodiments of the present invention disclosed herein.

The loop tapes 5013 of FIG. 71 may be substituted with other soft and durable materials. FIG. 72 shows an alternate design for the hinge mechanism for the fourth alternate embodiment of the present invention 5000. Referring to FIG. 72, the pins 5101*d*×2 engage with the grooves 5110*j*×2. This design eliminates the hinge 5011 and screws 5012×6 of FIG. 66. Dimension S is greater than dimension T.

Figure 73:
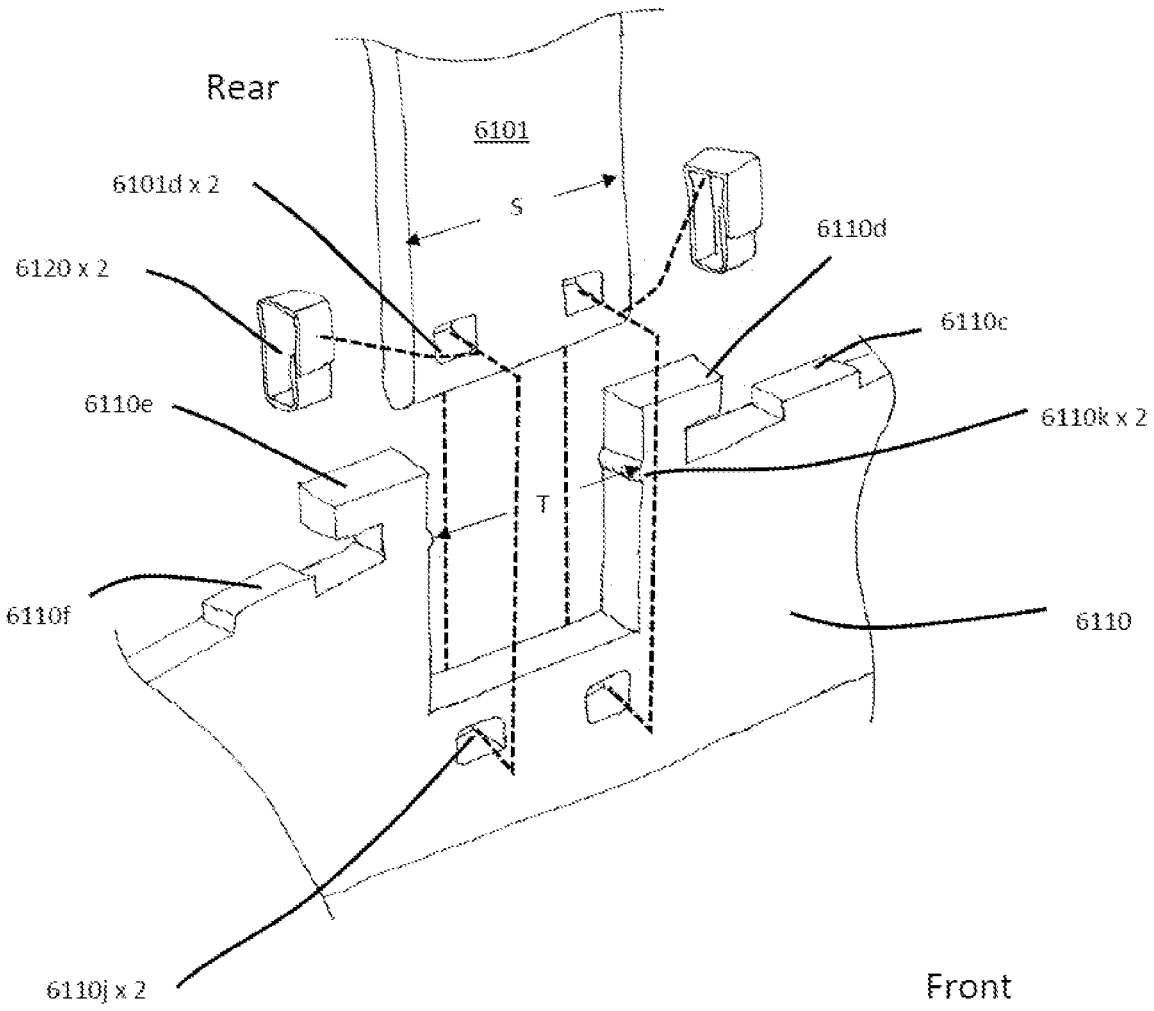
FIG. 73 shows an ISO view of the second alternate design of the hinge mechanism for the fourth alternate embodiment of the present invention 5000, according to embodiments of the present invention disclosed herein.
Figure 74:
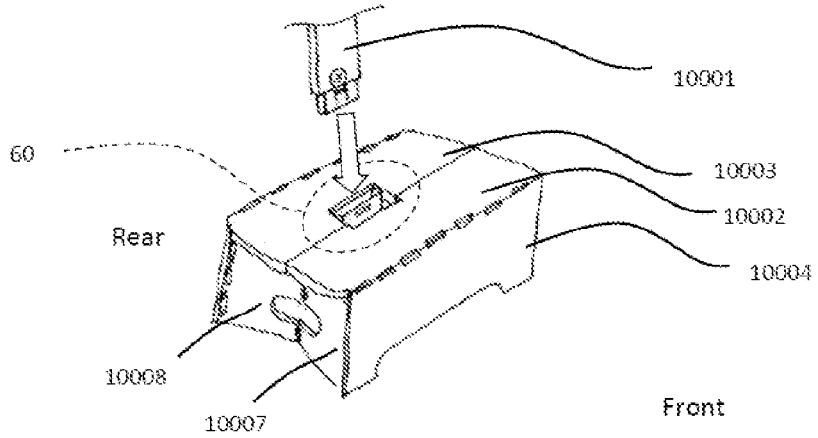
FIG. 74 shows an ISO view of the alternate design for the handles. This variation offers detachable handle and detachable smartphone shelf, according to embodiments of the present invention disclosed herein.
Figure 75:
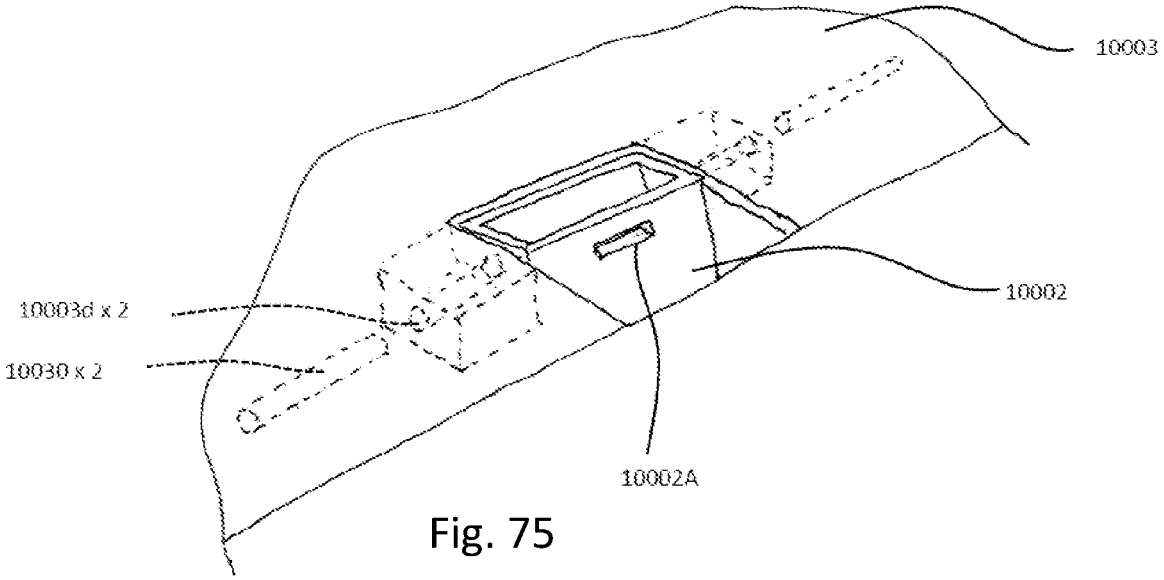
FIG. 75 shows an enlarged view of a circled area 60 in FIG. 74, according to embodiments of the present invention disclosed herein.

The handle 6101 and the cross member 6110 are connected with hook and loop tie band 6120×2 through the holes 6101×2 and 6110*j*×2 as shown in FIG. 73. Number of the holes and tie bands may be adjusted accordingly. The handle 6101 and the cross member 6110 may be connected with other methods know in the industry.

Figure 76:
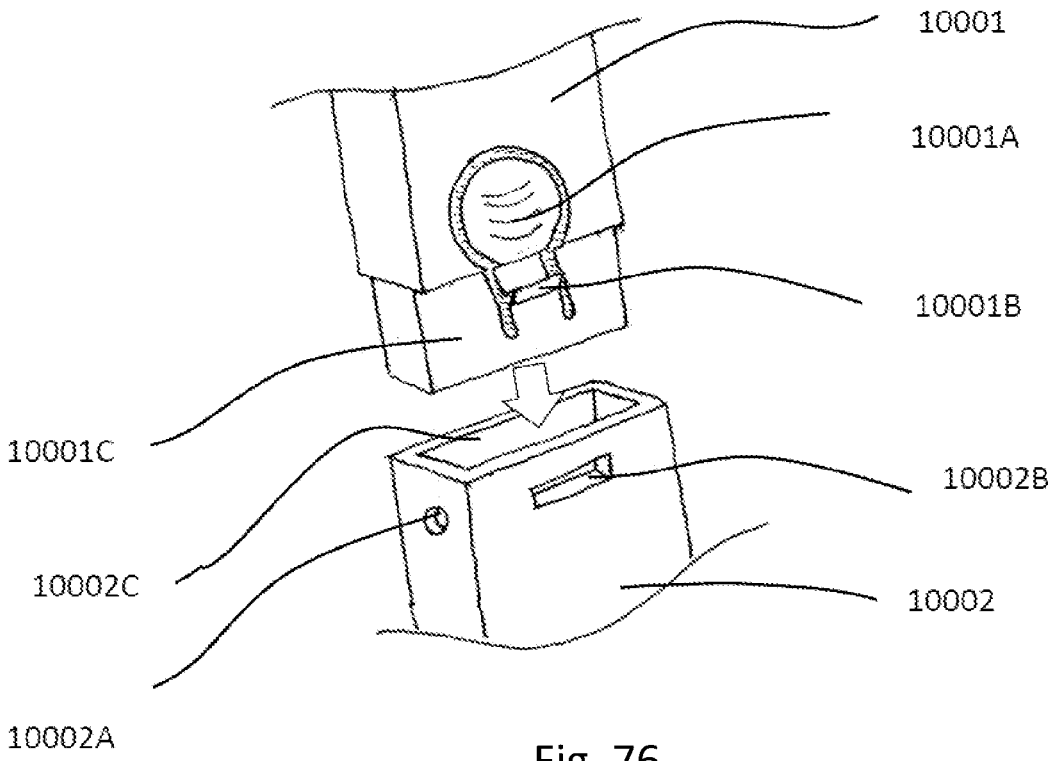
FIG. 76 shows the details of the latching mechanism for the top portion and bottom portion at pre-engage stage, according to embodiments of the present invention disclosed herein.
Figure 77:
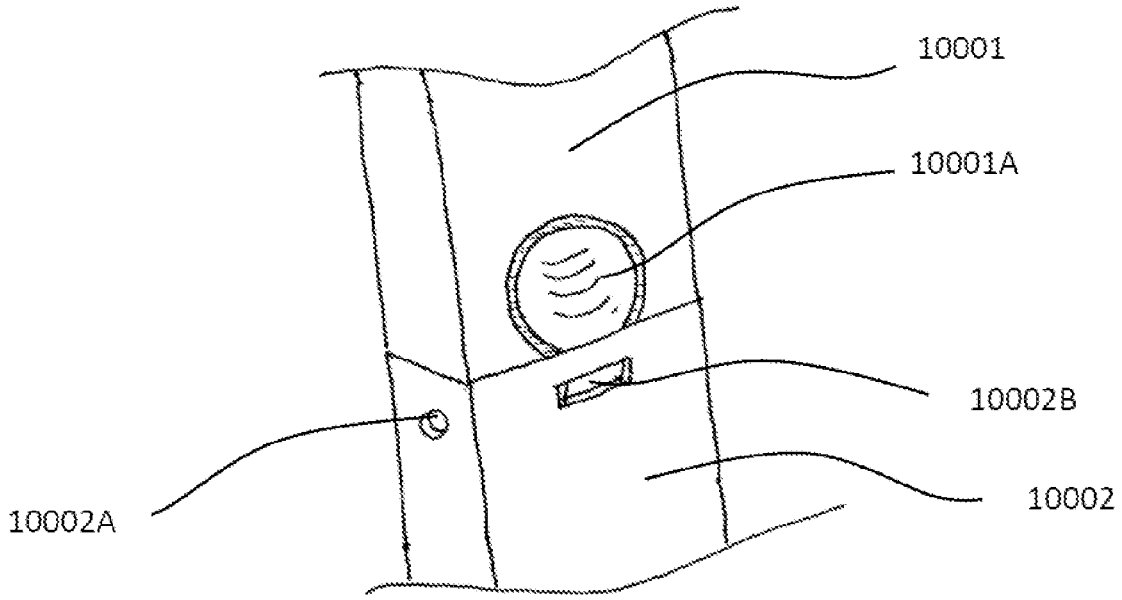
FIG. 77 shows the details of the latching mechanism for the top portion and bottom portion at engaged stage, according to embodiments of the present invention disclosed herein.
Figure 79:
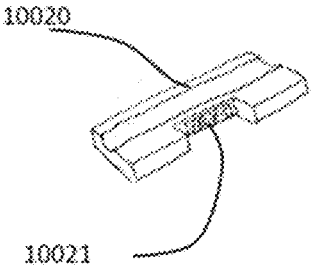
FIG. 79. shows an ISO view of the handle from the back side, according to embodiments of the present invention disclosed herein.
Figure 78:
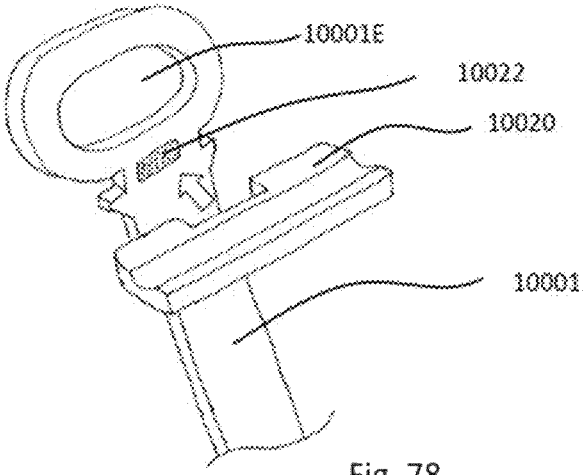
FIG. 78 shows an ISO view of how the handle and the smartphone shelf is assembled.
Figure 80:
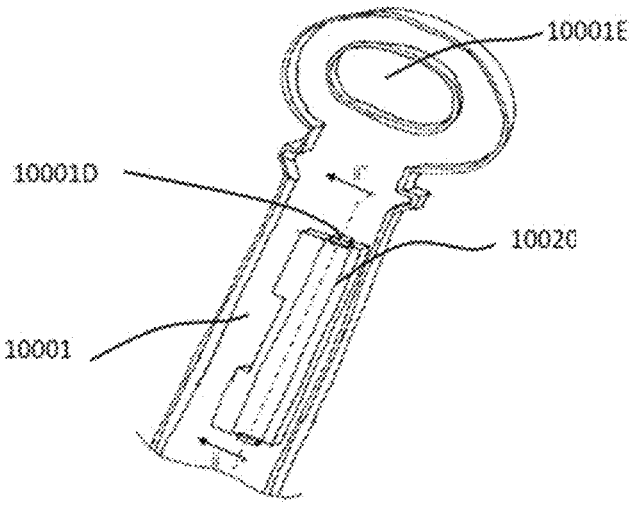
FIG. 80. shows an ISO view of the back of the handle with the smartphone shelf stored in the handle, according to embodiments of the present invention disclosed herein.
Figure 81:
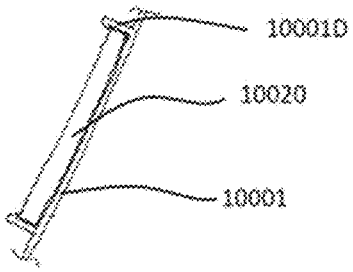
FIG. 81 shows a cross section of jj-jj" shown in FIG. 80, according to embodiments of the present invention disclosed herein.
Figure 82:
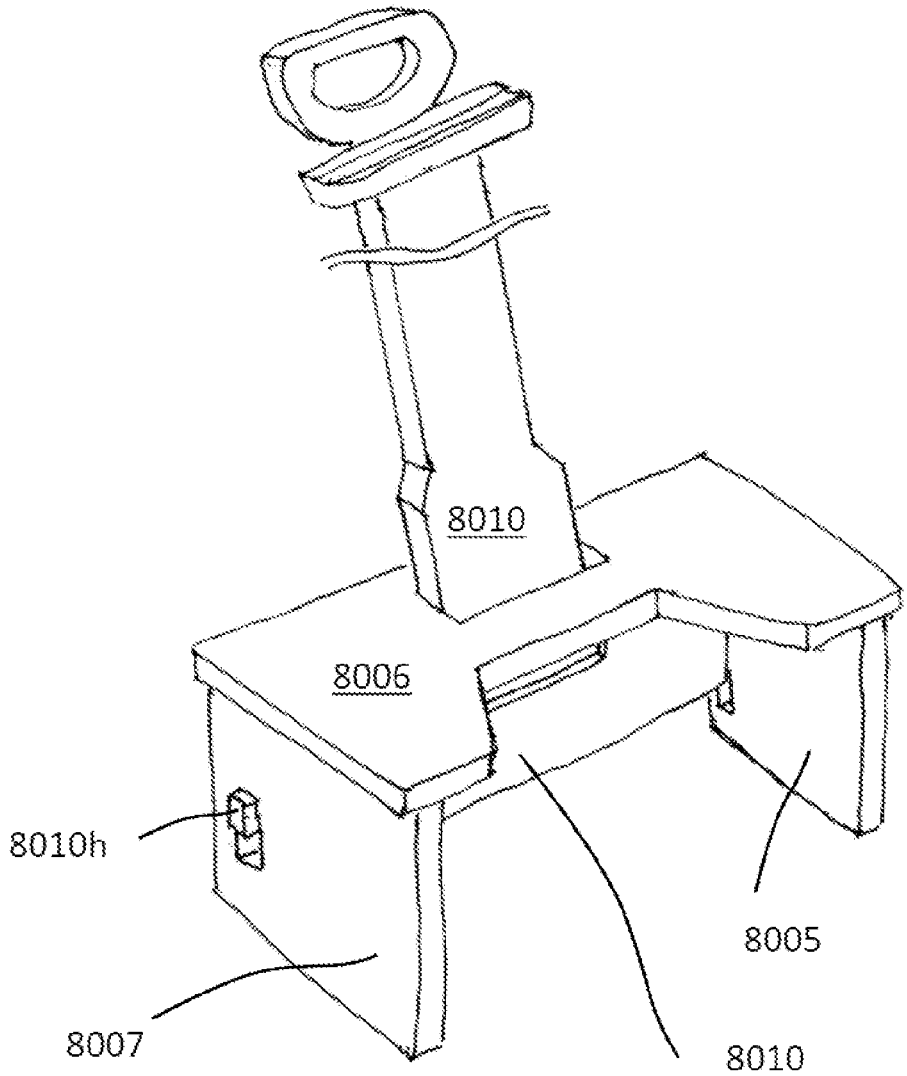
FIG. 82 shows an ISO view of the fifth alternate embodiment of the present invention 8000 in assembled stage, according to embodiments of the present invention disclosed herein.

FIG. 74 through FIG. 77 show the detail design for detachable handle. Claw 10001 on the release button 1001A engages with the hole 10002B as shown in FIGS. 76 and 77. Detachable smartphone shelf 10020 and the handle 10001 are assembled with the hook and loop tape on them as shown in FIG. 78 and FIG. 79. Smart phone shelf 10020 may be stored in the back of the handle 10001 as shown in FIG. 80 and FIG. 81.

Figure 83A:
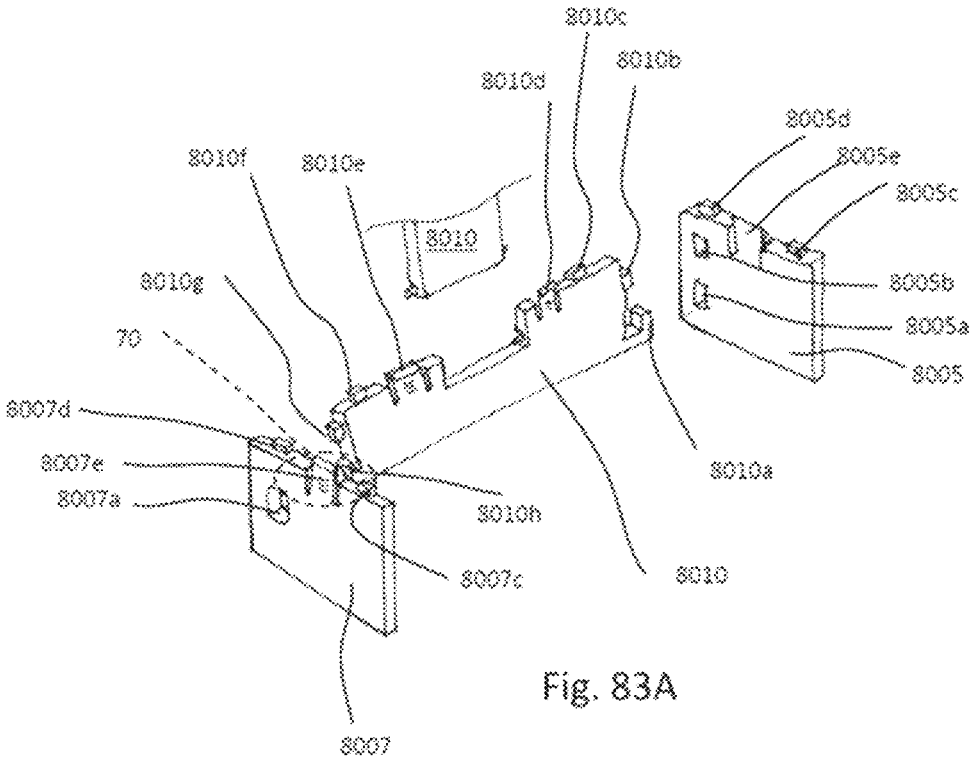
FIG. 83A shows an exploded view of the fifth alternate embodiment of the present invention 8000, according to embodiments of the present invention disclosed herein.
Figure 83B:
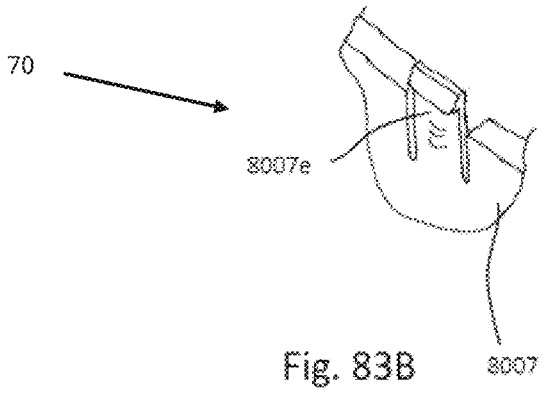
FIG. 83B shows an enlarged view of circle 70 shown in FIG. 83A.
Figures 83C, 83D:
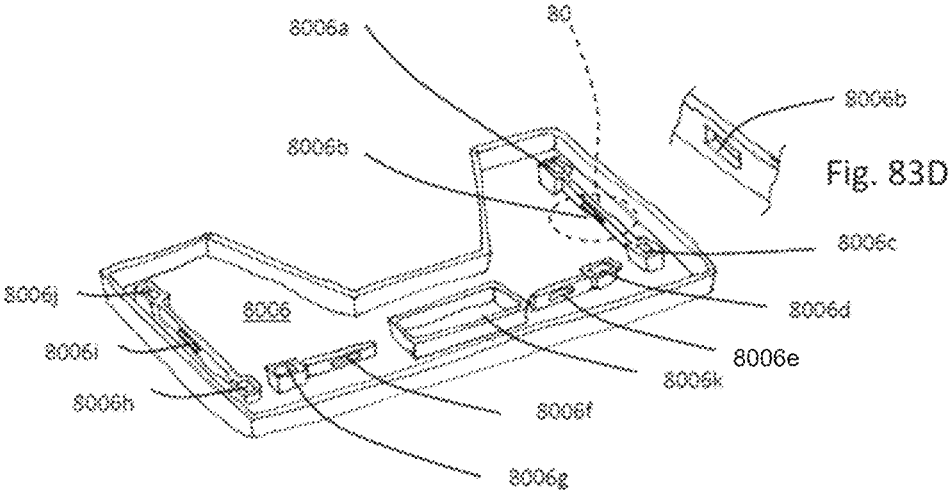
FIG. 83C shows an enlarged view of the circle shown in FIG. 83A, according to embodiments of the present invention disclosed herein.

Detachable handle and detachable smart phone shelf may be designed for all embodiments made with plastic injection molding. Claws 8005*e*, 8010*d*, 8010*e* and 8007*e* shown in FIG. 83A engage with the slots 8006*i*, 8006*f*, 8006*k* and 8006*b*.

The preferred length of the handle is approximately 700 mm, but it could be shorter or longer. The link plates in the preferred, first alternate and second alternate embodiments may have multiple living hinges or use flexible material such as fabric.

Figure 84:
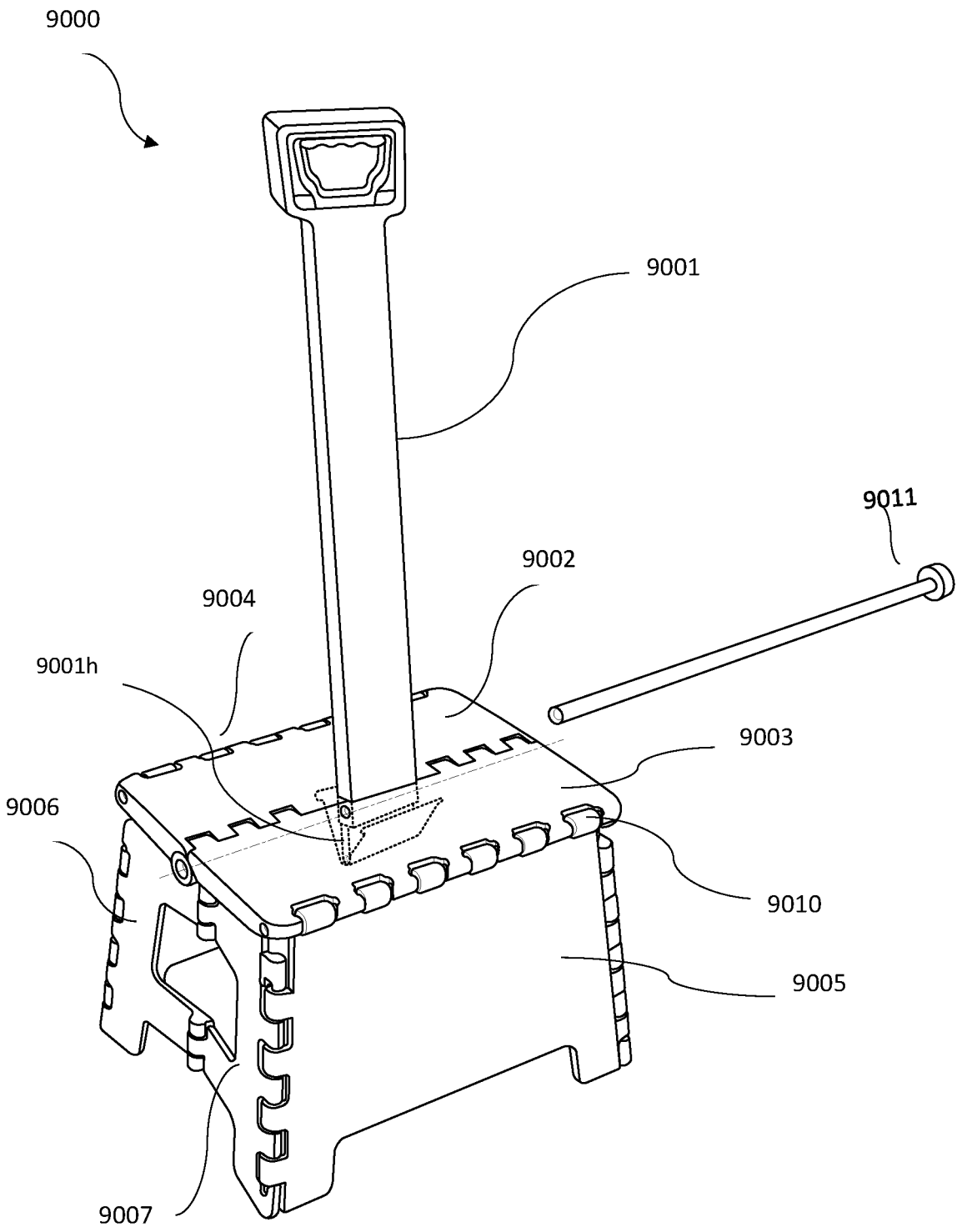
FIG. 84 illustrates a collapsible stool, according to embodiments of the present invention disclosed herein.
Figure 85:
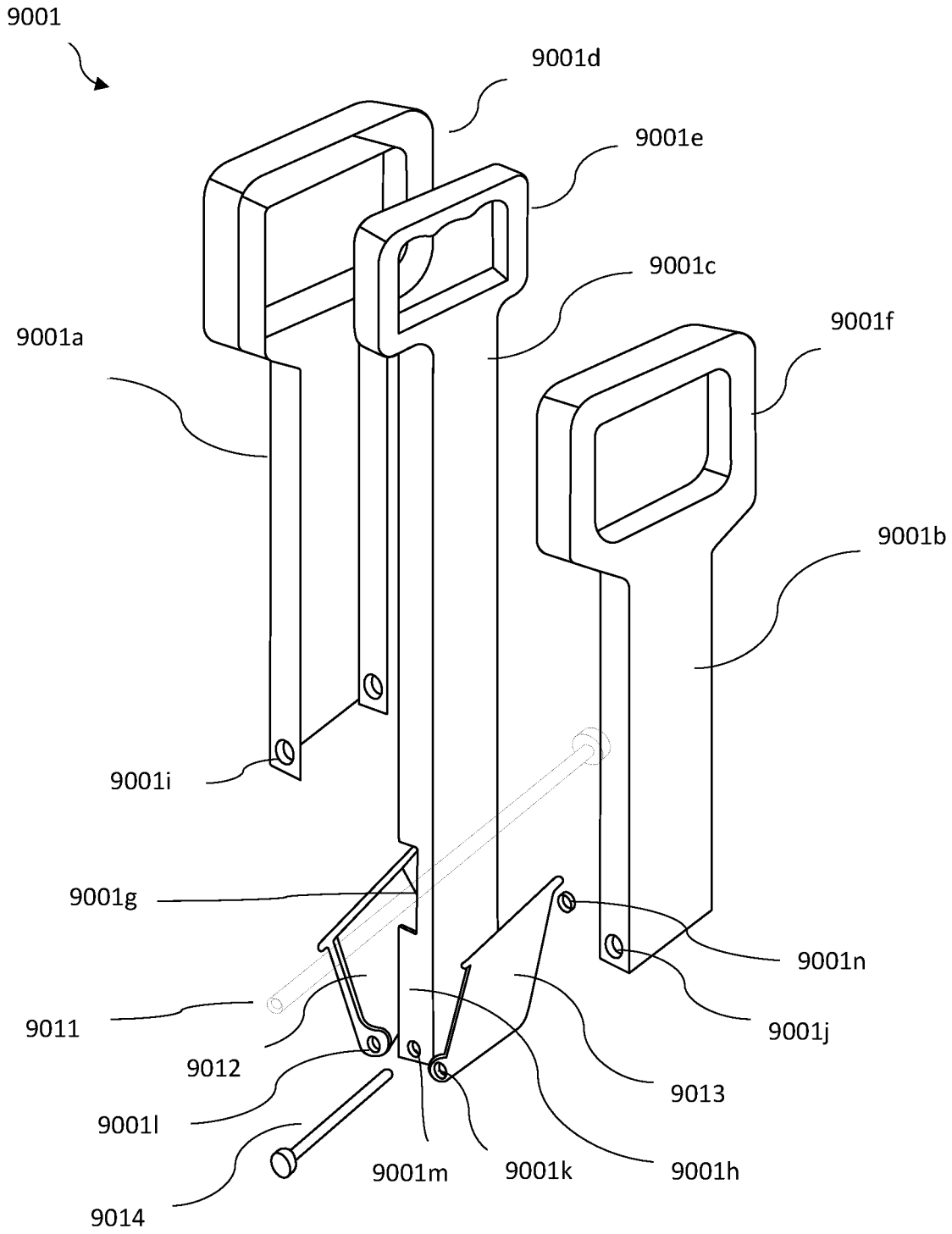
FIG. 85 illustrates handle of the collapsible stool, according to embodiments of the present invention disclosed herein.

Referring to FIGS. 84, a collapsible stool 9000 is disclosed. The collapsible stool includes a plurality of hinges 9010. The collapsible stool also includes a plurality of supporting members 9002, 9003, 9004, 9005, 9006, 9007, 9008 (not shown), 9009 (not shown) etc. connected via the plurality of hinges 9010. The plurality of supporting members includes at least two top members 9002, 9003, a front member 9005, a back member 9004, a pair of right-side members 9008, 9009 (not shown) and a pair of left side members 9006, 9007. The collapsible stool also includes a long handle 9001 connected to at least two top members with a plurality of connecting members. The long handle 9001 is connected to the supporting member a long pin 9011. In reference to FIG. 84 and FIG. 85, the long handle 9001 is elongated having an outer hollow member 9001*a*, 9001*b* and inner trigger member 9001*c*. The outer hollow member comprises of a first outer member 9001*a* and a second outer member 9001*b*. The second outer member 9001*b* fits into the first outer member 9001*a* to form a housing to house inner trigger member 9001*c*. In the embodiment the outer hollow member forms a D shaped grip 9001*d* to move the collapsible stool from one place to another.

In another embodiment, the inner trigger member 9001*c* is also modified into a D shaped trigger point 9001*e*. In the embodiment, the trigger point 9001*e* may be modified into T shaped instead of D shaped. In another embodiment, the D or T shaped trigger point may be modified into wavy curves to fit in comfort with fingers of users. In another embodiment, the grip 9001*d* has a larger perimeter than the trigger point 9001*e* so that trigger point may be positioned within the grip 9001*d*. In one of the embodiments, the first outer member 9001*a* has a bigger perimeter to receive the second outer member 9001*b* and form a housing for the trigger member of the handle.

In one of the embodiments, the handle 9001 is long that may comprise a first top part, a middle part and a bottom part. The first top part comprises a grip and trigger point. The middle portion is hollow to house trigger member 9001*c*. In the embodiment, the middle portion may be provisioned for holding smart phones or tablets. In the embodiment, the bottom part of the long handle is connected to the back side of the plurality of supporting members with at least two link plates 9012, 9013. The long handle 9001 further includes at least two link plates 9012, 9013 attached to the bottom part of the trigger member 9001*c* of the long handle 9001 through small pin 9014. At least two link plates 9012, 9013 are coupled to each of the two top supporting members 9002, 9003 of the plurality of supporting members. The long handle further includes a pulling lever mechanism located at the bottom part of the inner trigger member of the long handle 9001 and coupled to the inner trigger member or actuating component. Moreover, the pulling lever mechanism may be configured to deploy the plurality of supporting members via the actuating component when the trigger point of the handle 9001*e* is pulled. In the embodiment the collapsible stool gets closed when the stool is taken/pulled through D shaped grip 9001*d* of handle.

In the embodiment, the handle 9001 has two types of hinge mechanisms, a first hinge mechanism is associated with the inner trigger member 9001*c* and a second hinge mechanism is outer hollow members 9001*a*, 9001*b*. In accordance with the invention, the first hinge mechanism is responsible for deploying the pluralities of the support members to open the stool. The first hinge mechanism comprises bottom part 9001*h* of the trigger member that comprises bottom hole 9001*m*, a first link plate 9012 having a first link plate hole 90011, a second link plate 9013 having a second link plate hole 9001*k*, a washer 9001*n* and a short pin 9014. The first hinge mechanism deploys the pluralities of the support members to open the collapsible stool when trigger point 9001*e* is pulled. Further, the second hinge mechanism is responsible for closing of the collapsible stool when grip 9001*d*, 9001*f* is pulled. The hinge mechanism comprises a pluralities of holes 9001*i* of first outer member 9001*a*, a pluralities of holes 9001*j* of the second outer member 9001*b*, notch 9001*g* of the trigger member and long pin 9011 that passes through the hinges of the two top supporting members 9002, 9003.

Figure 86:
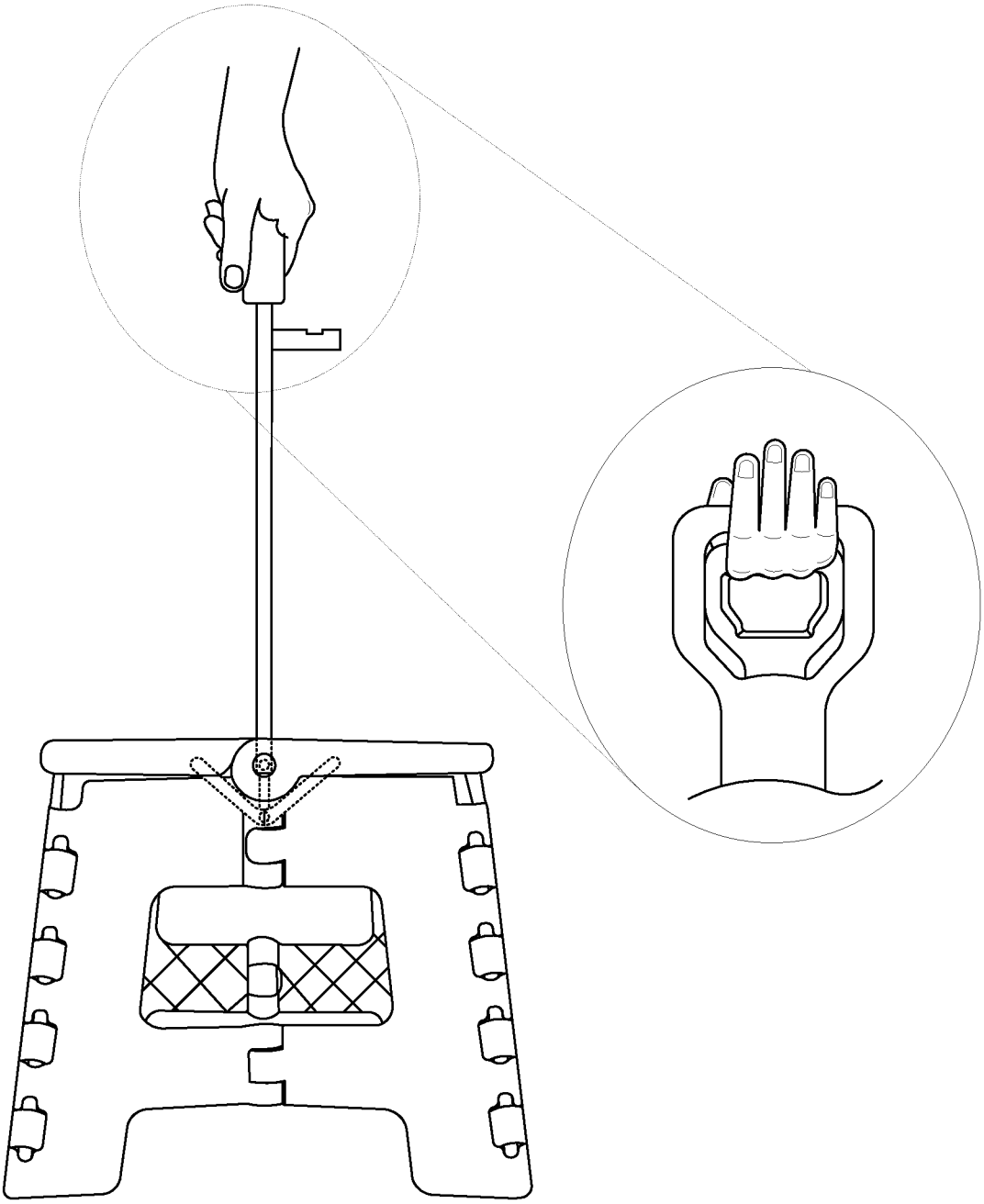
FIG. 86 illustrates an open collapsible stool when trigger is pulled in accordance to embodiments of the present invention disclosed herein.
Figure 87:
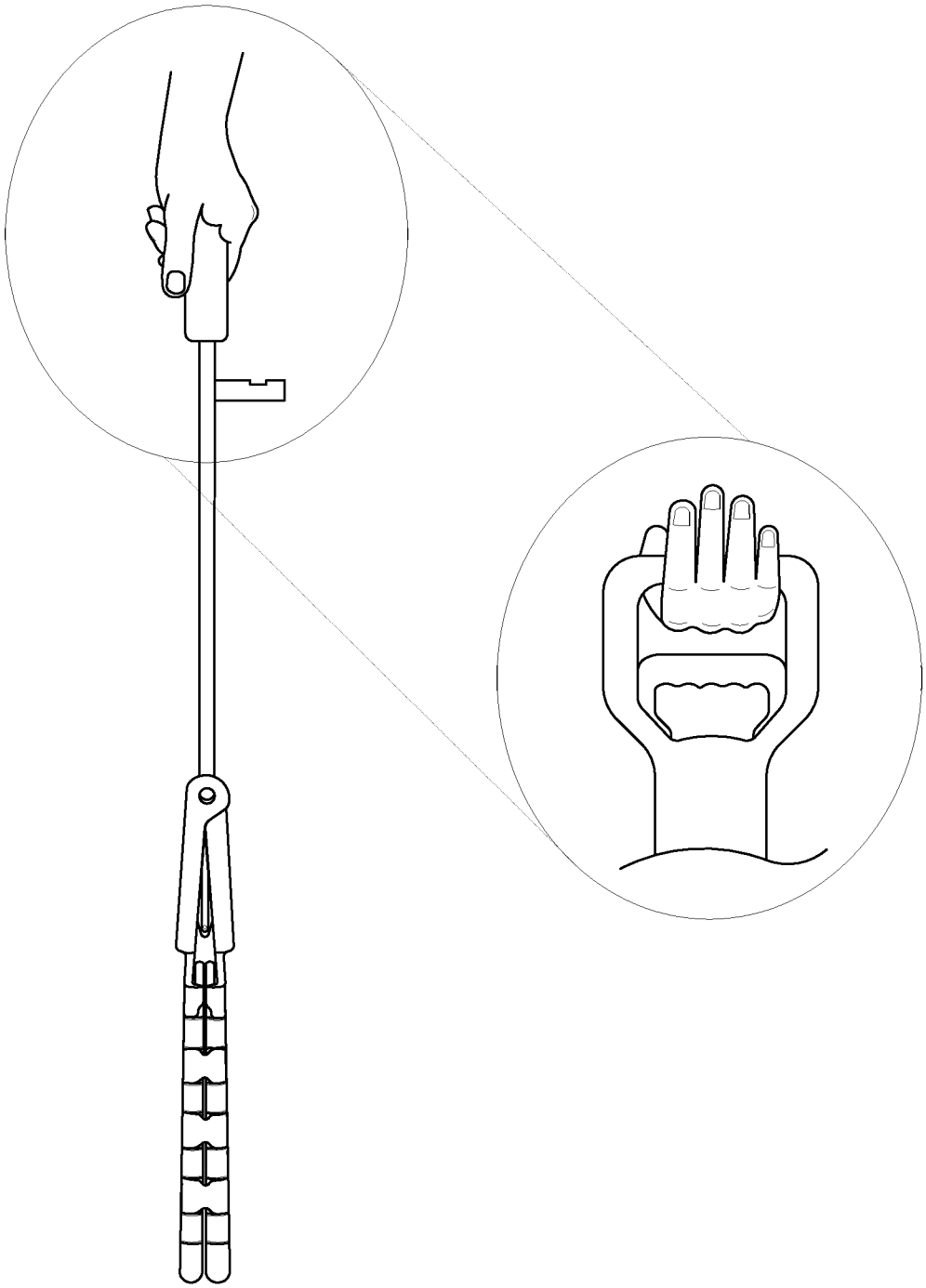
FIG. 87 illustrates a collapsed stool in accordance to embodiments of the present invention disclosed herein.
Figure 88A:
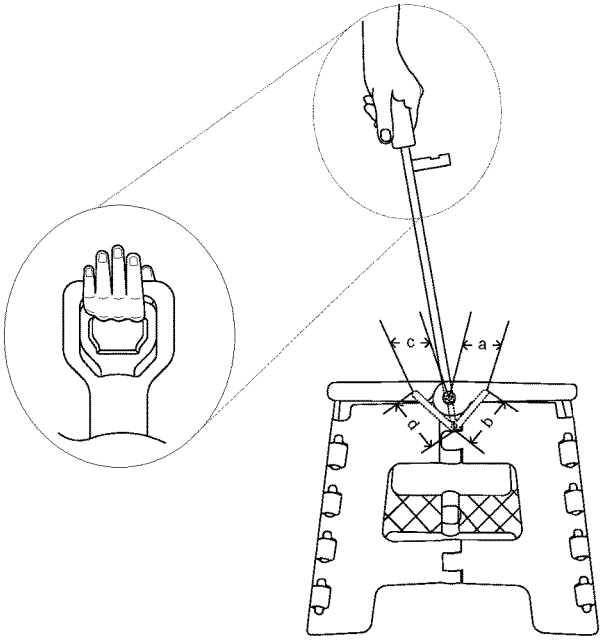
FIG. 88A TO 88D illustrates a collapsed stool in accordance to embodiments of the present invention disclosed herein.
Figure 88B:
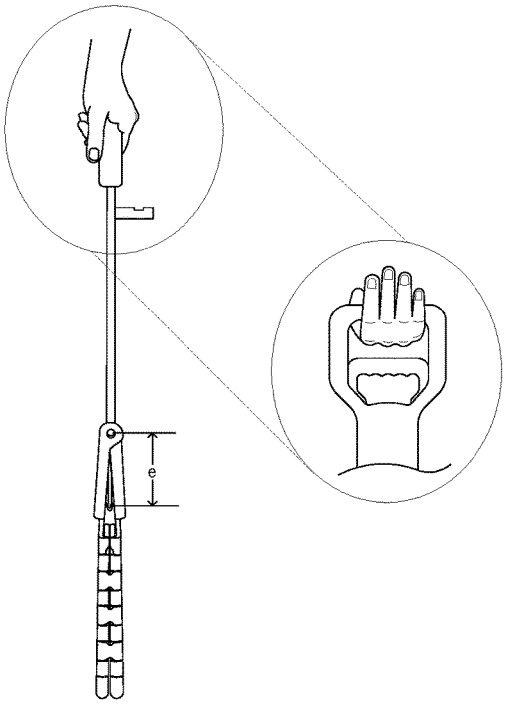
Figure 88C:
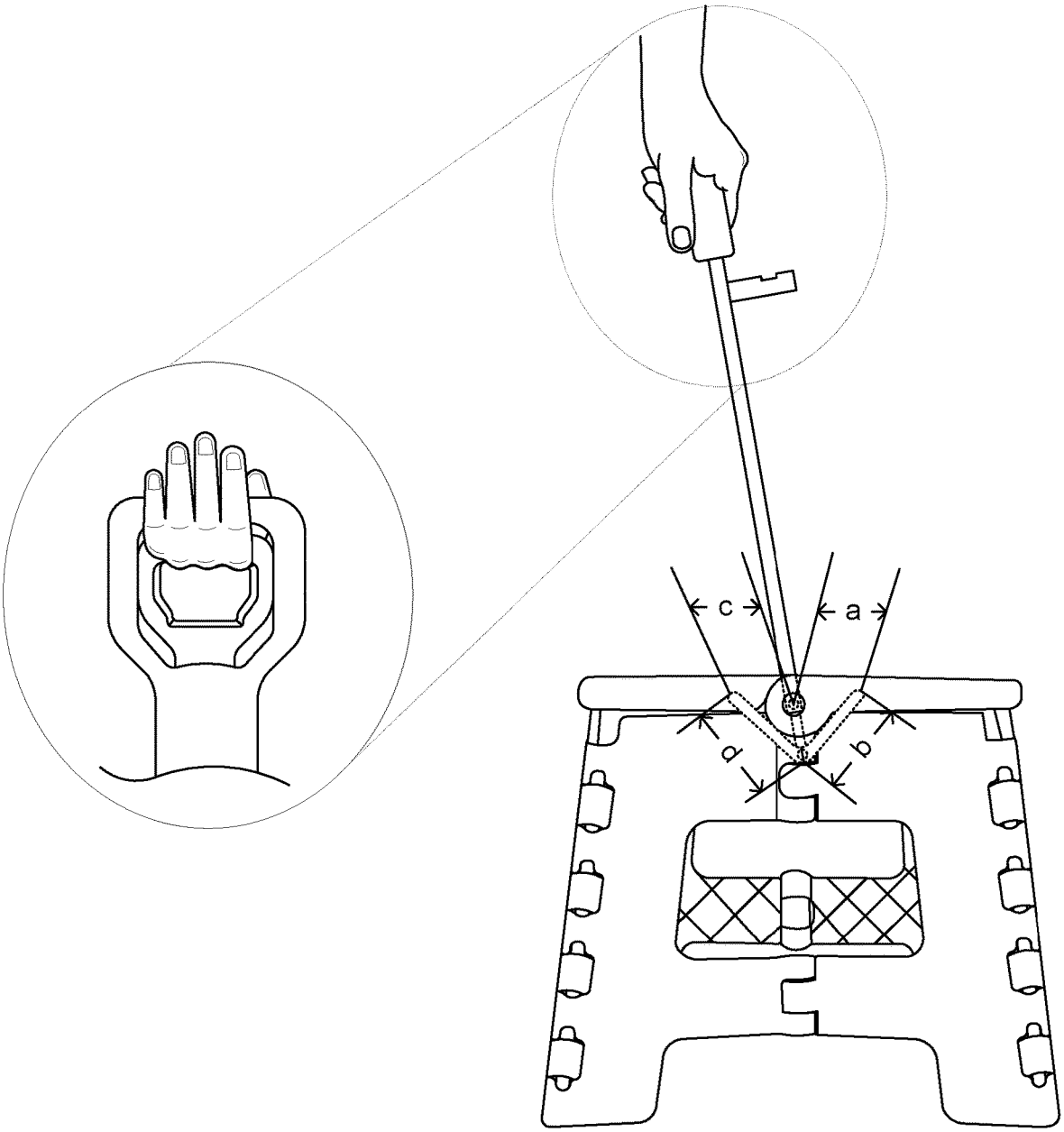
Figure 88D:
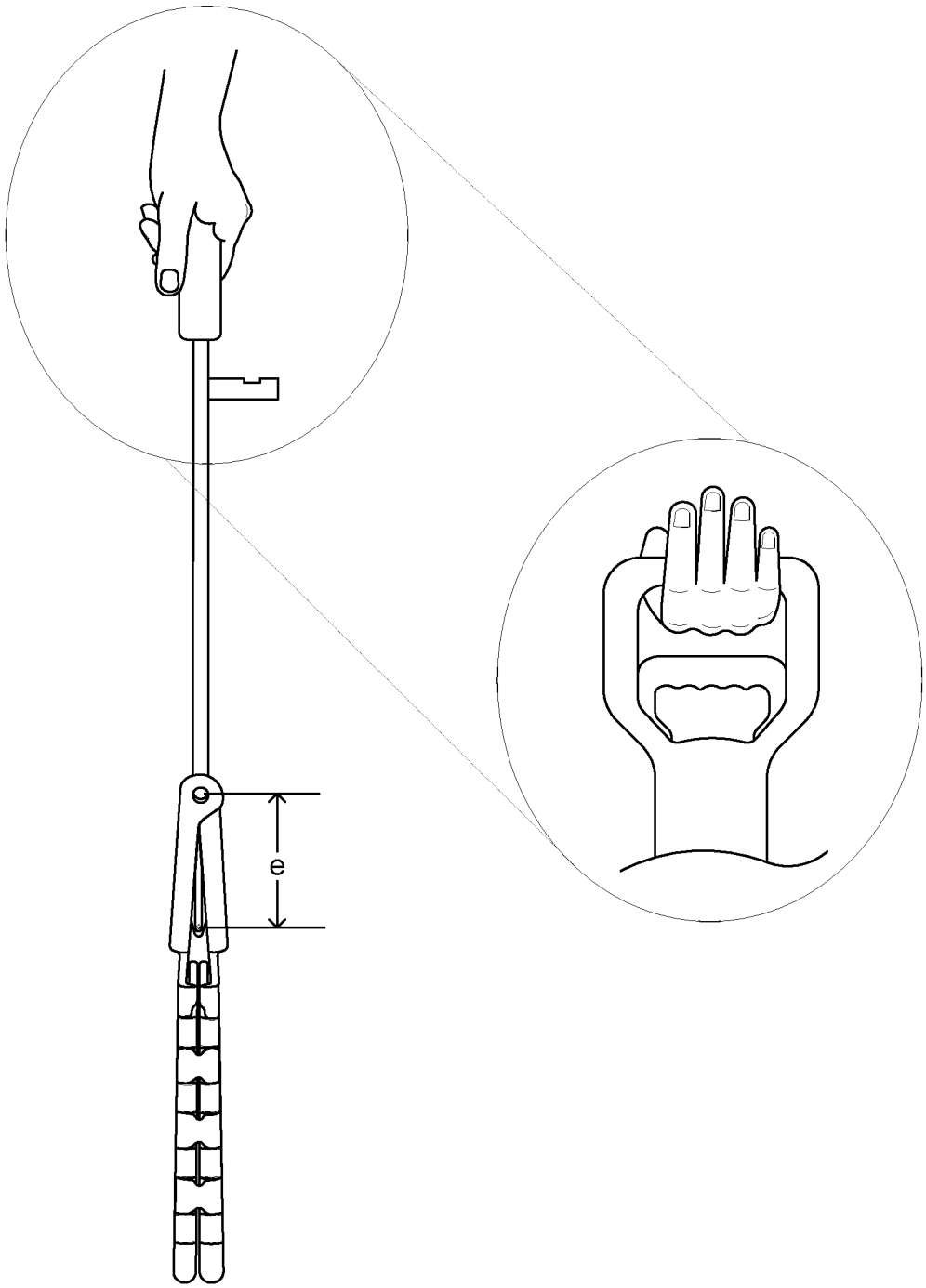

FIG. 86 to FIG. 87, illustrate an open collapsible stool when trigger point is pulled in accordance to embodiments of the present invention and a collapsed stool when the stool is pulled with D shaped grip 9001*d*, 9001*f* of bigger perimeter.

FIG. 88A to 88D illustrates a collapsed stool in accordance to embodiments of the present invention disclosed herein. In the embodiment, in deployed collapsible stool is determined by formula (a+b=c+d=e). wherein the a≥c and d≥b, wherein the a, b, c, d, e are various distances shown in FIG. 88A to 88 D. While the invention has been described in connection with what is presently considered to be the most practical and various embodiments, it will be understood that the invention is not to be limited to the disclosed embodiments, but on the contrary, is intended to cover various modifications and equivalent arrangements included within the scope of the appended claims.

A person of ordinary skill in the art may be aware that, in combination with the examples described in the embodiments disclosed in this specification, units and algorithm steps may be implemented by electronic hardware, computer software, or a combination thereof.

The foregoing descriptions of specific embodiments of the present technology have been presented for purpose of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical software, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the software or implementation without departing from the spirit or scope of the claims of the present technology.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

In a case that no conflict occurs, the embodiments in the present disclosure and the features in the embodiments may be mutually combined. The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A stool comprising:

a plurality of hinges;

a plurality of supporting members connected by the plurality of hinges, the plurality of supporting members including at least two top members, a front member, a back member, a pair of right side members and a pair of left side members; and a vertically handle having a top part, a middle part and a bottom part located between the two top members;

wherein the elongated handle is connected to at least one of the plurality of supporting members with one or more connecting members at the bottom part of the handle.

2. The stool of claim 1, wherein the plurality of supporting members are foldable due to hinge joints.

3. The stool of claim 2, wherein the elongated handle comprises side edges and upper and lower pins on each of the side edges, such that one of the two top members is located between the upper and lower pins of each side edge of the elongated handle.

4. The stool of claim 1, wherein the plurality of supporting members are in an open position when pushed down against the floor by applying the downward force through the elongated handle.

5. The stool of claim 2, wherein the elongated handle comprises a lever mechanism to fold the plurality of supporting members when the elongated handle is lifted up.

6. The stool of claim 1, wherein the one or more connecting members comprises one or more link plates, a pin, at least one pivot pin, one or more linkages, a hinge mechanism, or any combination thereof.

7. The stool of claim 1, wherein the elongated handle comprises:

a foldable component attached to the bottom part of the elongated handle and coupled to one of the plurality of supporting members;

an actuating component located in the middle part of the elongated handle and coupled to the foldable component;

a pulling lever mechanism located in the top part of the elongated handle and coupled to the actuating component; wherein the pulling lever mechanism is configured to fold the plurality of supporting members via the actuating component when the pulling lever is pulled.

8. The stool of claim 7, wherein the plurality of supporting members are in an unfolded position when the actuating component is triggered.

9. The stool of claim 1, wherein the elongated handle is set at any position between a frontmost position to a rearmost position.

10. The stool of claim 1, wherein the elongated handle comprises a shelf for holding a smart phone or a tablet.

11. The stool of claim 1, wherein the top part of the elongated handle is detachably connected to the middle part of the elongated handle via a latching mechanism.

12. A foldable stool comprising:

a plurality of hinges;

a plurality of supporting members connected via the plurality of hinges, the plurality of supporting members including at least two top members, a front member, a back member, a pair of right side members and a pair of left side members;

an elongated handle including an outer hollow member and an inner trigger member housed in the outer hollow member;

wherein the inner trigger member has a bottom part configured for deploying the plurality of supporting members to open the stool with a first hinge mechanism; and the outer hollow member is configured to close the stool with a second hinge mechanism.

13. The foldable stool of claim 12, wherein the outer hollow member comprises a first outer member and a second outer member, such that the second outer member fits into the first outer member to form a housing to house the inner trigger member.

14. The foldable stool of claim 12, wherein the first hinge mechanism is coupled to the bottom part of the inner trigger member comprising a bottom hole, a first link plate having a first link plate hole, a second link plate having a second link plate hole, a washer and a pin.

15. The foldable stool of claim 12, wherein the second hinge mechanism comprises a plurality of holes at the first outer member, a plurality of holes at the second outer member, a notch on the inner trigger member and a pin that passes through the hinges of the two top supporting members.

16. The foldable stool of claim 12, wherein the elongated handle includes a top part and a middle part, such that the top part is detachably connected to the middle part via a latching mechanism.

17. A collapsible stool comprising:

a plurality of hinges;

a plurality of supporting members connected via the plurality of hinges, the plurality of supporting members including at least two top members, a front member, a back member, a pair of right-side members and a pair of left side members;

an elongated handle comprising an outer hollow member and an inner trigger member housed in the outer hollow member, wherein the inner trigger member has a bottom part connected to the at least two top support members with a plurality of connecting members, the plurality of connecting members comprising a bottom hole, a first link plate having a first link plate hole, a second link plate having a second link plate hole, a washer and a pin;

the outer hollow member comprises a first outer member and a second outer member, such that the second outer member fits into the first outer member to form a housing to house the inner trigger member, wherein outer hollow member is connected to the at least two top supporting members through a plurality of holes at the first outer member, a plurality of holes at the second outer member, a notch on the inner trigger member and a pin that passes through the hinges of the at least two top supporting members;

wherein the inner trigger member is adopted to deploy the supporting members by a pull action of a trigger point of the elongated handle, and the outer hollow member of the elongated handle is adopted to close the supporting members by a pull action of a grip of the elongated handle.

* * * * *